US010170849B2

(12) United States Patent
Tanaka et al.

(10) Patent No.: US 10,170,849 B2
(45) Date of Patent: Jan. 1, 2019

(54) CONNECTOR AND CONNECTOR ASSEMBLY WITH SLIDABLE LATCH

(71) Applicant: Molex, LLC, Lisle, IL (US)

(72) Inventors: Daiki Tanaka, Yamato (JP); Yuji Naito, Yamato (JP); Naoto Yoshikawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/933,056

(22) Filed: Mar. 22, 2018

(65) Prior Publication Data

US 2018/0294586 A1 Oct. 11, 2018

Related U.S. Application Data

(60) Provisional application No. 62/482,775, filed on Apr. 7, 2017.

(30) Foreign Application Priority Data

Jun. 27, 2017 (JP) ..... 2017-125303

(51) Int. Cl.

| | |
|---|---|
| ***H01R 12/00*** | (2006.01) |
| ***H01R 12/70*** | (2011.01) |
| ***H01R 12/71*** | (2011.01) |
| ***H01R 12/52*** | (2011.01) |

(52) U.S. Cl.

CPC ..... *H01R 12/7058* (2013.01); *H01R 12/52* (2013.01); *H01R 12/716* (2013.01)

(58) Field of Classification Search

CPC ..... H01R 12/716; H01R 13/62; H01R 12/73

USPC ..... 439/74, 347

See application file for complete search history.

(56) References Cited

U.S. PATENT DOCUMENTS

| | | | | |
|---|---|---|---|---|
| 3,425,025 | A * | 1/1969 | Williams | H01R 13/629 361/600 |
| 4,969,830 | A * | 11/1990 | Daly | G06F 1/1632 200/50.1 |
| 6,645,005 | B2 * | 11/2003 | Wu | H01R 12/707 439/563 |
| 6,994,581 | B2 * | 2/2006 | Sung | G06K 19/077 439/347 |
| 7,104,830 | B1 * | 9/2006 | Diaz | H01R 13/6395 439/347 |
| 7,128,581 | B2 * | 10/2006 | Igarashi | H01R 12/716 439/74 |
| 8,292,635 | B2 * | 10/2012 | Little | H01R 12/7029 439/570 |

(Continued)

FOREIGN PATENT DOCUMENTS

| | | |
|---|---|---|
| JP | 03-266380 A | 11/1991 |
| JP | 2015-060764 A | 3/2015 |
| JP | 2015-082446 A | 4/2015 |

*Primary Examiner* — Neil Abrams
(74) *Attorney, Agent, or Firm* — James A. O'Malley

(57) ABSTRACT

A receptacle connector is provided with a slider and a first securing metal fitting. The slider can slide between a locking position where the slider locks a plug connector and a lock releasing position where the slider is separated from the plug connector to an outer side in a longitudinal direction such that locking of the plug connector is released. The first securing metal fitting has the hook, and the slider has the first engageable part that engages with the hook to retain the slider in a selected position.

9 Claims, 18 Drawing Sheets

(56) References Cited

U.S. PATENT DOCUMENTS

| | | | | |
|---|---|---|---|---|
| 8,408,931 | B2 * | 4/2013 | Sato | H01R 12/7052 439/357 |
| 8,512,055 | B2 * | 8/2013 | Lu | G06F 1/188 439/160 |
| 8,647,141 | B2 * | 2/2014 | Lee | H01R 13/639 439/372 |
| 9,178,309 | B2 * | 11/2015 | Tanaka | H01R 13/6271 |
| 9,231,322 | B2 | 1/2016 | Ozeki | |
| 9,240,654 | B2 * | 1/2016 | Takemoto | H01R 12/7029 |
| 9,257,766 | B2 * | 2/2016 | Takemoto | H01R 12/716 |
| 9,620,874 | B2 * | 4/2017 | Takemoto | H01R 12/716 |
| 9,740,249 | B2 * | 8/2017 | Top | G06F 1/185 |
| 9,887,473 | B2 * | 2/2018 | Lee | H01R 12/716 |
| 2012/0257360 | A1 * | 10/2012 | Sun | H01R 12/7052 361/748 |
| 2016/0156117 | A1 * | 6/2016 | Wang | H01R 12/714 439/65 |

* cited by examiner

CONNECTOR AND CONNECTOR ASSEMBLY WITH SLIDABLE LATCH

RELATED APPLICATIONS

This application claims priority to U.S. Provisional Patent Application No. 62/482,775, filed Apr. 7, 2017 and to Japanese Application No. 2017-125303, filed Jun. 27, 2017, both of which are incorporated herein by reference in their entirety.

TECHNICAL FIELD

The present disclosure relates to a connector and a connector assembly.

BACKGROUND ART

Conventionally, a connector for connecting two circuit boards facing each other is used (for example, refer to Patent Document 1).

The two circuit boards are connected by mutually mating a connector attached to one circuit board and a connector attached to the other circuit board. In conjunction with the downsizing and thinning of electronic devices, reduction in height of this kind of connector is advancing.

Patent Document 1: JP2015-60764A

SUMMARY

As the height of the connector is reduced, the contact area between the terminals of the two connectors is reduced. Therefore, the contact stability of the terminals of the two connectors becomes a more important issue.

One object of the present disclosure is to provide a connector and a connector assembly capable of maintaining the contact stability of a terminal even when the contact area of the terminal of the connector is reduced as the height of the connector is reduced.

An example of a connector assembly proposed in the present disclosure has: a first connector provided with a first housing having two first wall parts extending in a longitudinal direction and opposing in a short direction, two second wall parts positioned on end parts of the two first wall parts and opposing in the longitudinal direction, and a recessed part formed on an inner side of the first wall parts and second wall parts, and including a plurality of first terminals aligned in the longitudinal direction and retained by the first housing; and a second connector having a plurality of second terminals for connecting to the plurality of first terminals, and a second housing retaining the plurality of second terminals, the second connector being mated to an inner side of the recessed part of the first housing. The first connector includes: a slider supported by at least one of the two second wall parts and that can slide in the longitudinal direction; and a first metal fitting attached to the second wall part. The slider can slide between a locking position where the slider locks the second connector mated to the inner side of the recessed part and a lock releasing position where the slider is separated from the second connector to an outer side in the longitudinal direction such that locking of the second connector is released. The first metal fitting has an engaging part, and the slider has a first engageable part to which the engaging part engages. At least one of the engaging part and first engageable part can elastically deform. Movement of the slider from the locking position to the lock releasing position is restricted by engagement between the engaging part and first engageable part, and sliding between the locking position and lock releasing position is permitted by at least one of the aforementioned parts.

An example of a connector proposed in the present disclosure has: a housing having two first wall parts extending in a longitudinal direction and opposing in a short direction, two second wall parts positioned on end parts of the two first wall parts and opposing in the longitudinal direction, and a recessed part formed on an inner side of the first wall parts and second wall parts; a plurality of terminals aligned in the longitudinal direction and retained by the housing; a slider supported by at least one of the two second wall parts and that can slide in the longitudinal direction; and a metal fitting attached to at least one of the second wall parts. The slider can slide between a locking position where the slider locks a mating connector mated to the inner side of the recessed part and a lock releasing position where the slider is separated from the mating connector to an outer side in the longitudinal direction such that locking of the mating connector is released. The metal fitting has an engaging part, and the slider has a first engageable part to which the engaging part engages. At least one of the engaging part and first engageable part can elastically deform. Movement of the slider from the locking position to the lock releasing position is restricted by engagement between the engaging part and first engageable part, and sliding between the locking position and lock releasing position is permitted by at least one of the aforementioned parts.

DETAILED DESCRIPTION OF THE PREFERRED EMBODIMENTS

The connector and the connector assembly proposed in the present disclosure are described below. The connector assembly of the present disclosure includes a connector to which a plurality of electric wires or circuit boards are connected, and a connector connected to a circuit board. The circuit board is, for example, a printed wiring board (Printed Circuit Board), a flexible flat cable (Flexible Flat Cable), a flexible printed wiring board (Flexible Printed Circuit), and the like, used for electronic equipment and the like, but any type of circuit board may be used. Further, the electric wire may be any type of electric wire such as a single core electric wire or a coaxial electric wire. A plurality of electric wires may be arranged in one direction.

In the present disclosure, a connector assembly including a connector connected to one circuit board and a connector connected to another circuit board is described as one example of a connector assembly. By mating the two connectors, the two circuit boards are electrically connected.

Figure 1A:
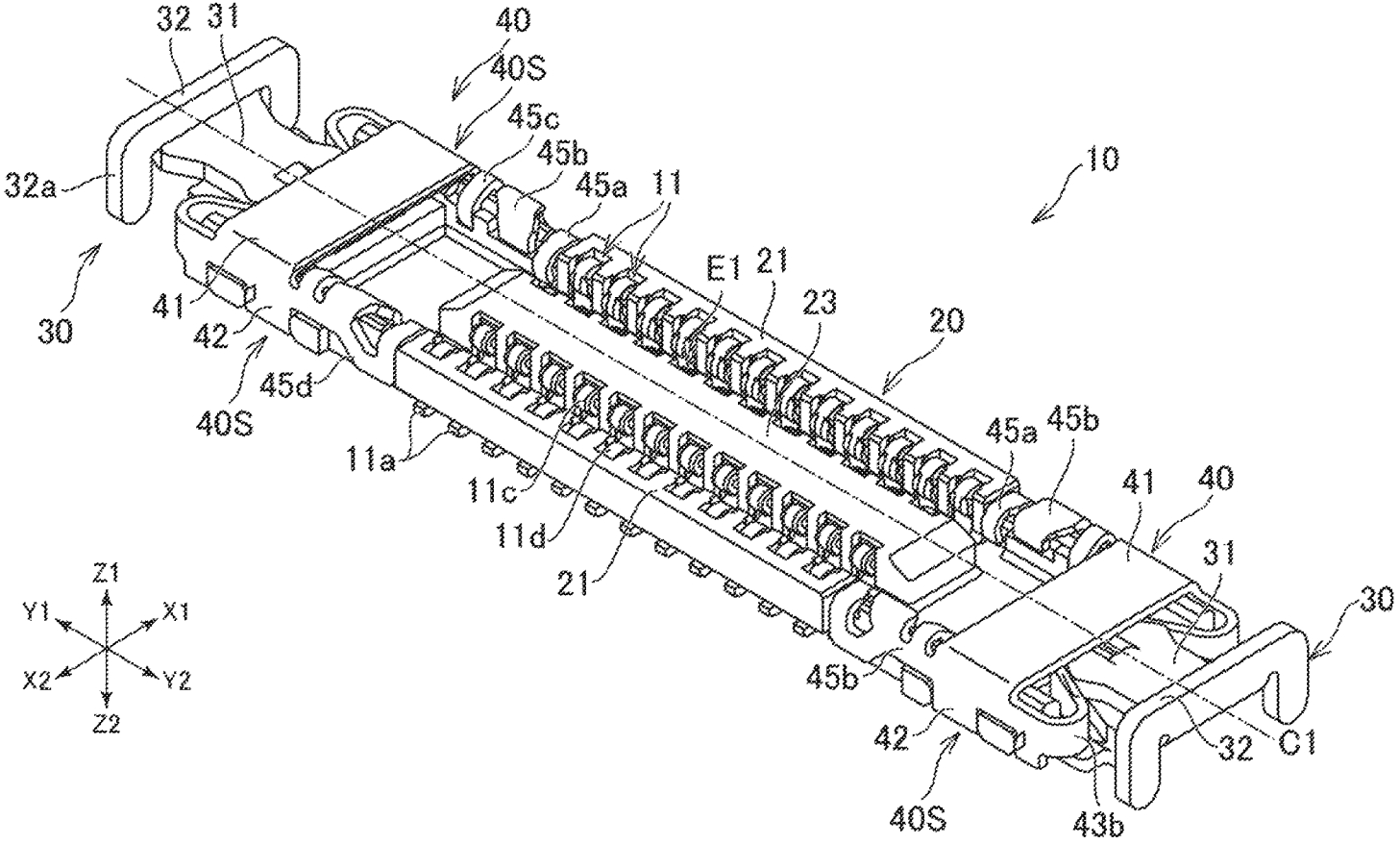
FIG. 1A is a perspective view illustrating an upper surface of a first connector (receptacle connector).
Figure 2A:
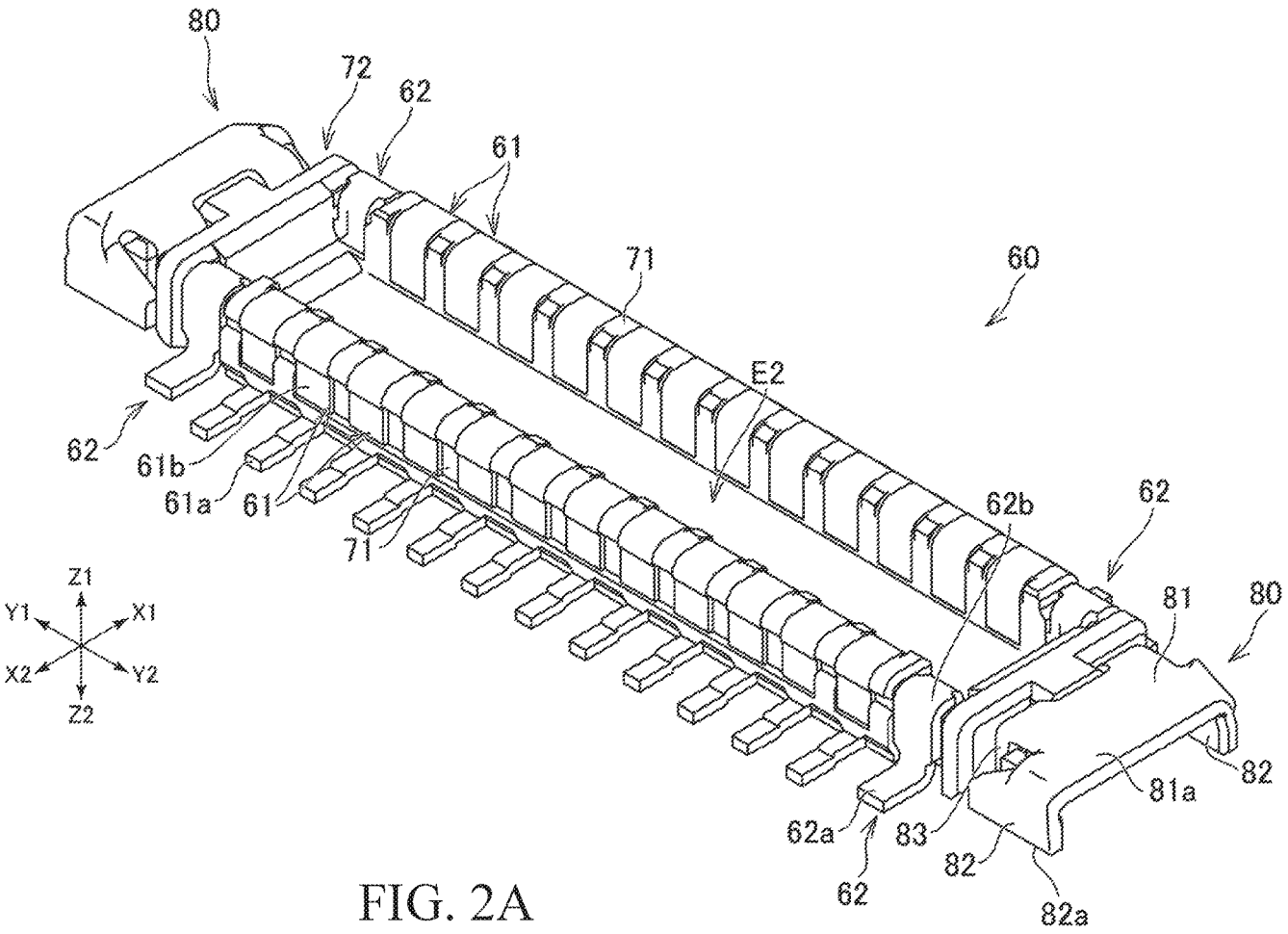
FIG. 2A is a perspective view illustrating an upper surface of a second connector (plug connector).
Figure 3A:
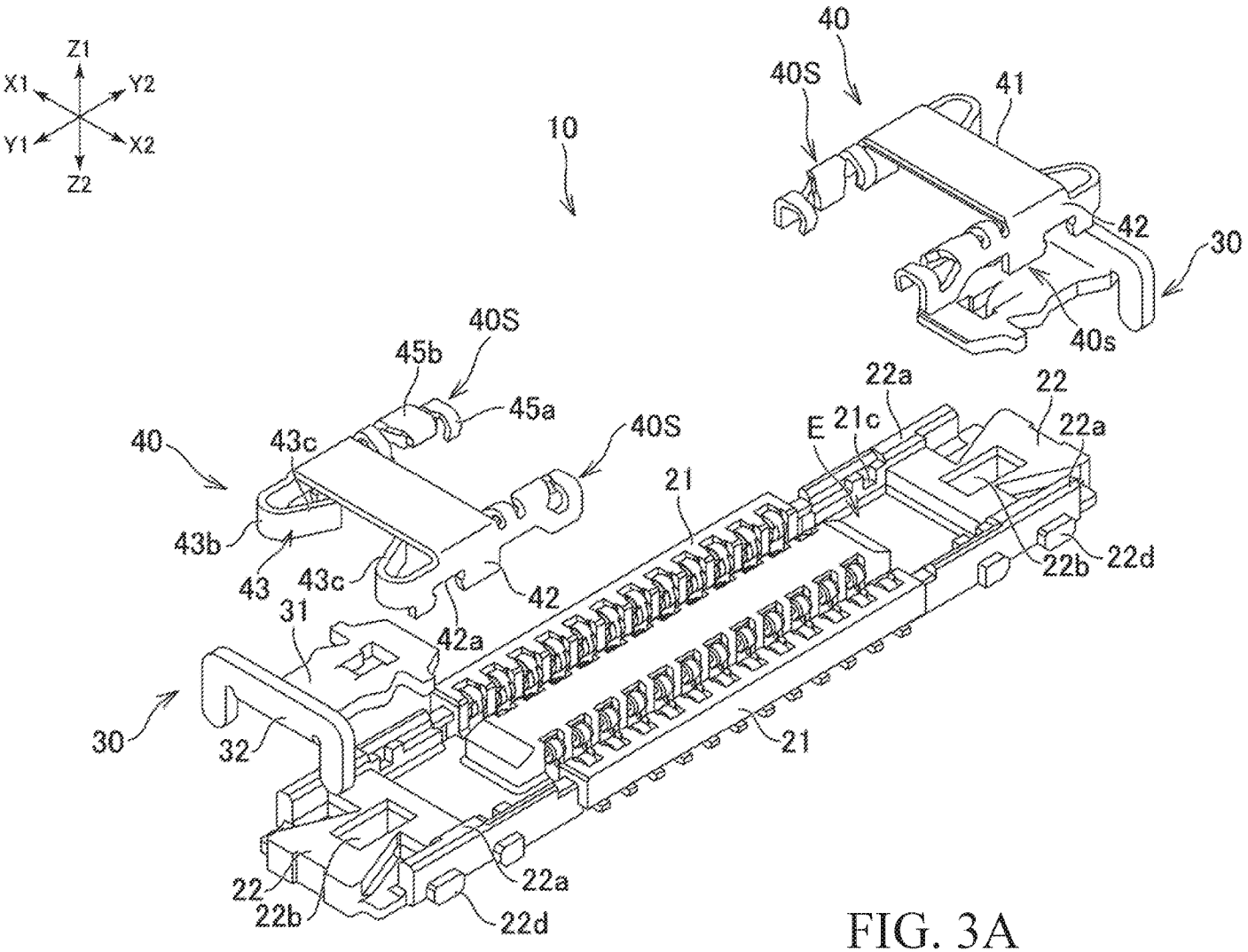
FIG. 3A is a perspective view illustrating a state in which a first connector is disassembled.
Figure 3B:
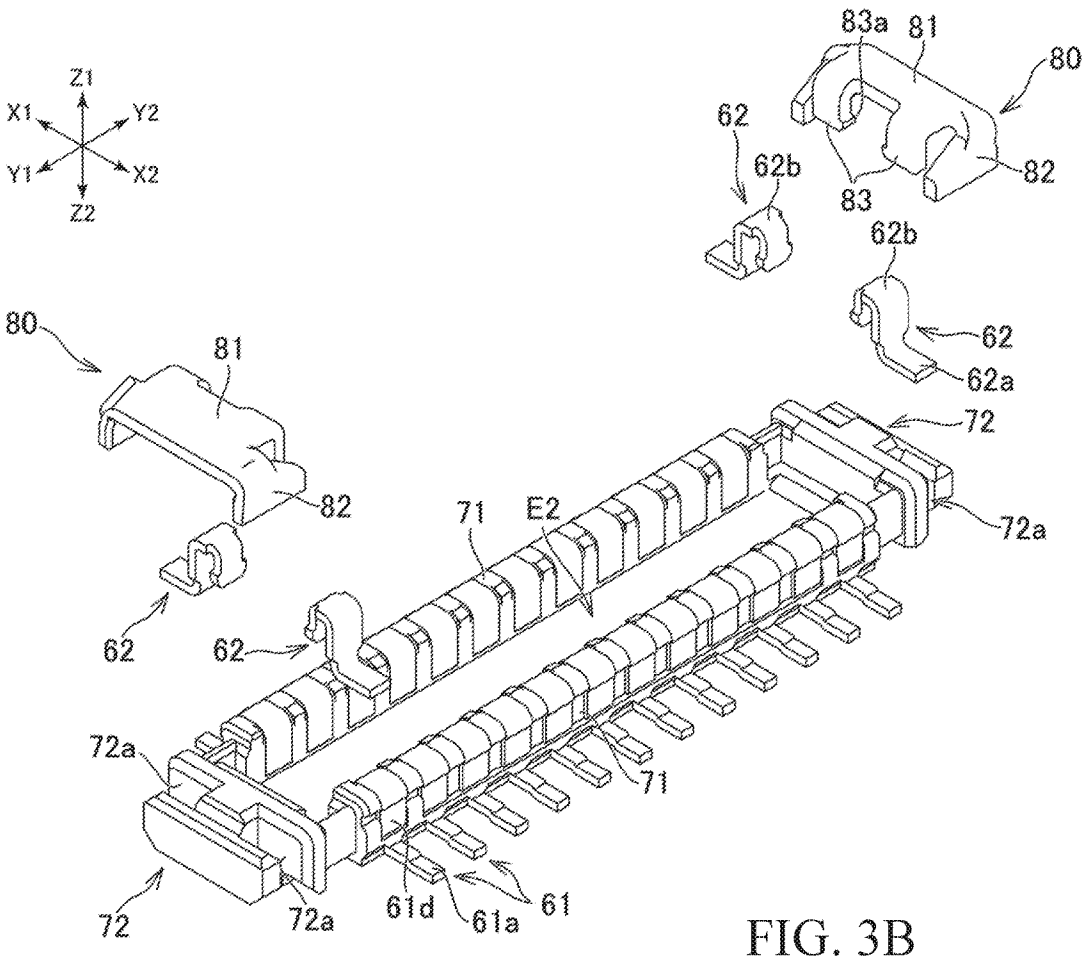
FIG. 3B is a perspective view illustrating a disassembled state of the second connector.

In the following description, the directions indicated by Z1 and Z2 in FIG. 1A is referred to as upward and downward, the direction indicated by Y1-Y2 in FIG. 1A is referred to as the "longitudinal direction" and the direction indicated by X1-X2 in FIG. 1A is referred to as the "short direction". These directions are used to explain the relative positional relationship and the relative action of the connectors constituting the connector assembly, members thereof, and parts. That is, these directions are not absolute, but are relative. Therefore, these directions do not limit the orientation of the connector and the connector assembly when using the connector and the connector assembly. The directions described in the present disclosure should be interpreted as changing in accordance with a change in the orientation of the connector and the connector assembly. FIGS. 2A and 3B illustrate the second connector 60 described below. In these figures, the second connector 60 is disposed in an orientation in which the side to be mated with the first connector 10 is on the upper side. In the following description, in a state where the second connector 60 and the first connector 10 are mated together, the second connector 60 is disposed in an orientation in which the side mated to the first connector 10 is on the lower side. Therefore, the positional relationship of the respective parts of the second connector 60 described with reference to FIG. 2A or 3B, and the positional relationship of the respective parts of the second connector 60 described in the mated state of the connectors 10, 60, are inverted in the vertical direction.

First Connector

Figure 4:
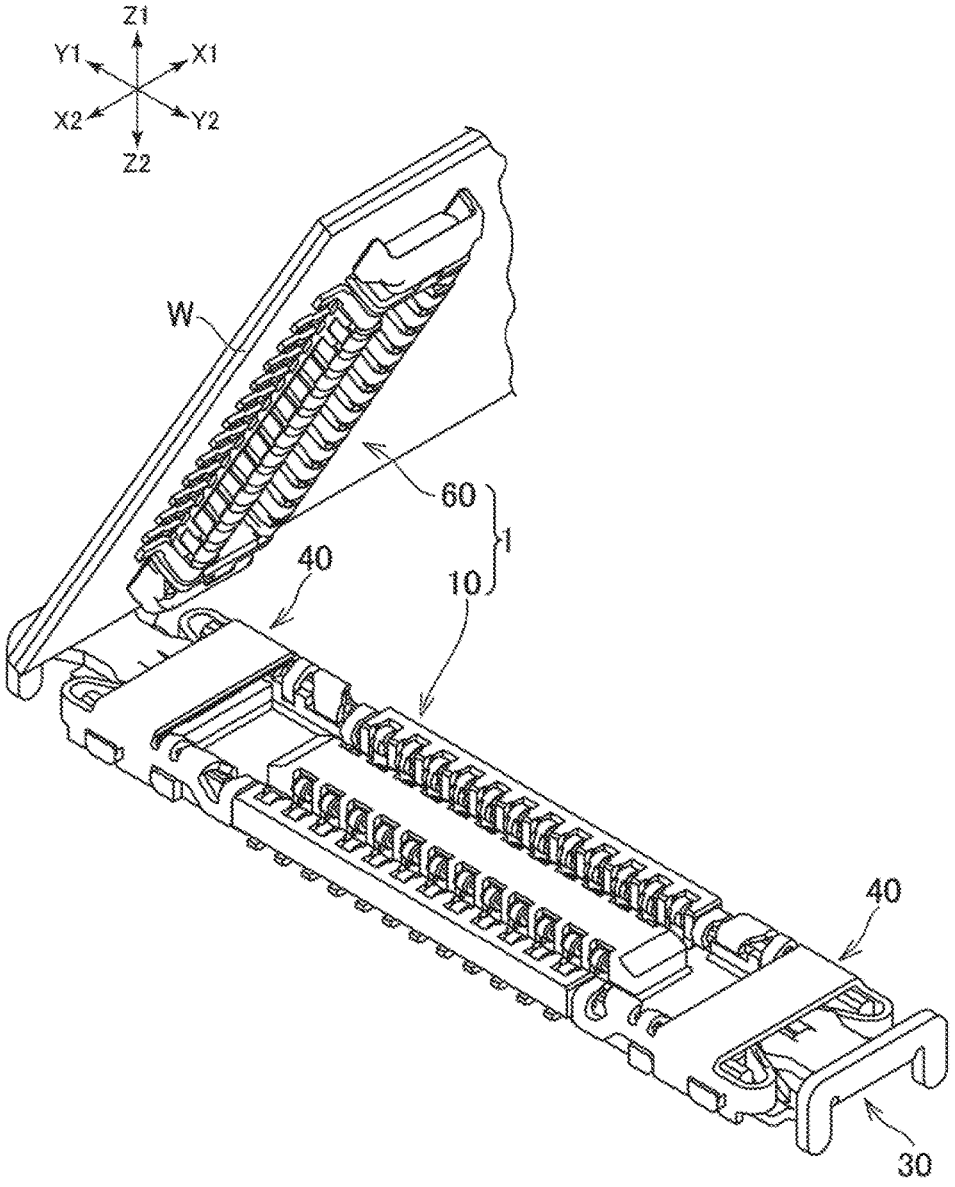
FIG. 4 is a perspective view illustrating a connector assembly in which a first connector and a second connector are mutually separated.

As illustrated in FIG. 4, the connector assembly 1 includes a receptacle connector 10 as a first connector and a plug connector 60 as a second connector.

As illustrated in FIG. 1A, the receptacle connector 10 has a first terminal 11 for connecting a circuit board (not illustrated) on which the receptacle connector 10 is mounted to a second terminal 61 of the plug connector 60 (refer to FIG. 2A). Further, the receptacle connector 10 has a first housing 20 that holds the first terminal 11. The receptacle connector 10 may have multiple first terminals 11 aligned in the longitudinal direction. Furthermore, the receptacle connector 10 may include a first securing metal fitting 40 as a first metal fitting for securing the first housing 20 to the circuit board, and a slider 30 slidably mounted on the first housing 20. As described below in detail, the first housing 20 has two second wall parts 22 positioned on opposite sides in the longitudinal direction of the connector. In the example of the receptacle connector 10, the slider 30 and the first securing metal fitting 40 are mounted on each of the two second wall parts 22. Unlike the example of the receptacle connector 10, the slider 30 and the first securing metal fitting 40 may be mounted only on one of the second wall parts 22.

Figure 1B:
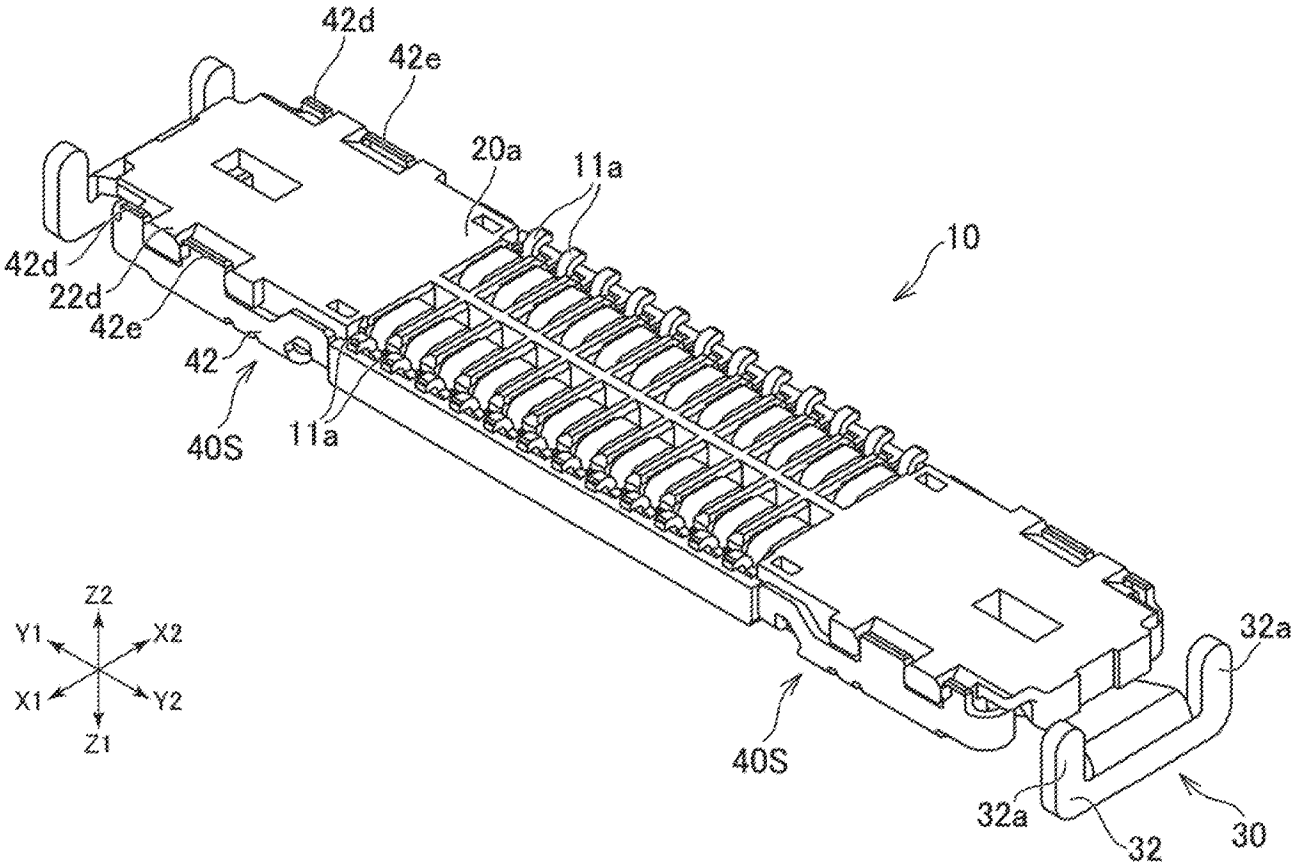
FIG. 1B is a perspective view illustrating a lower surface of the first connector.
Figure 1C:
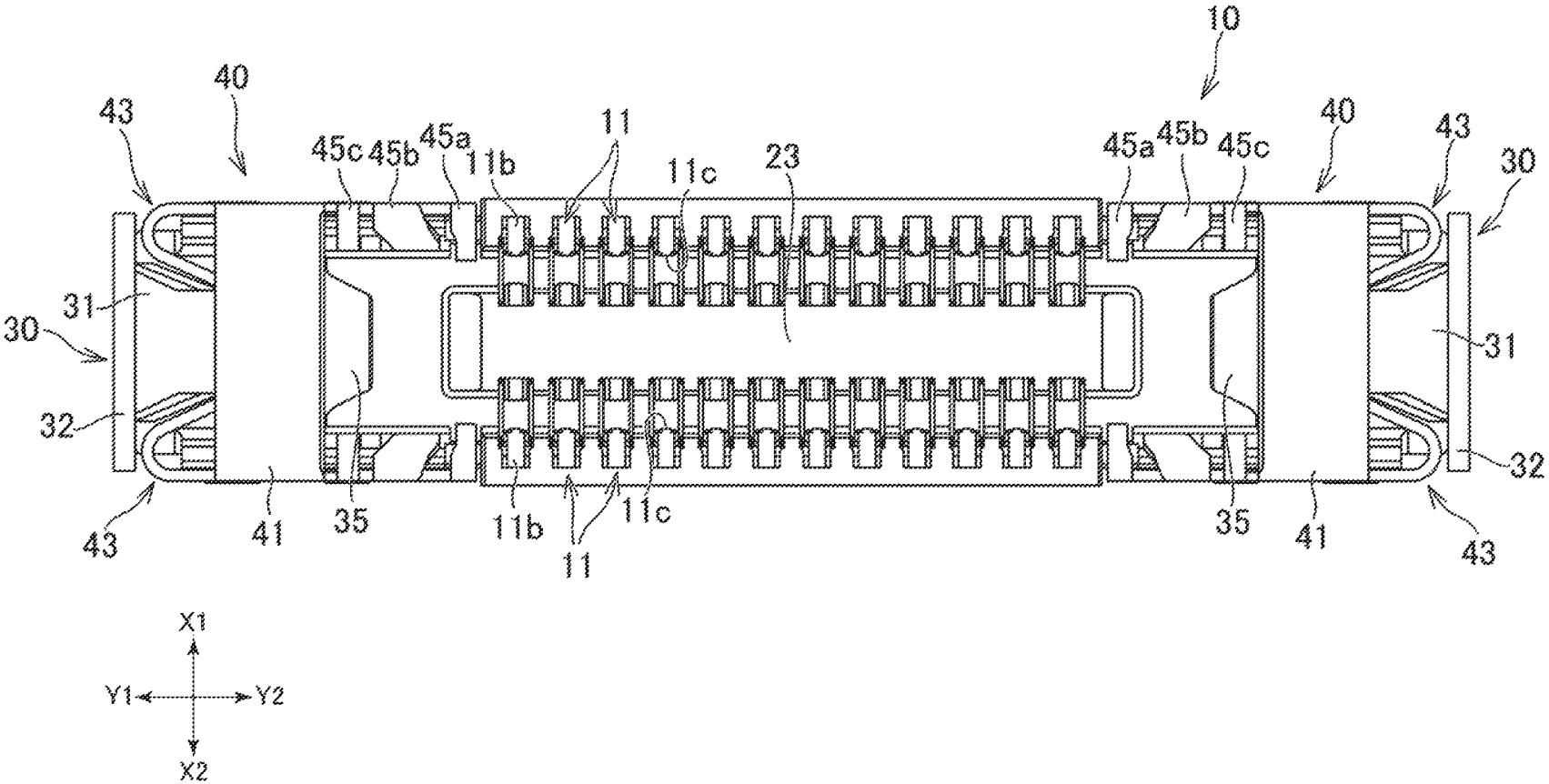
FIG. 1C is a plan view illustrating the upper surface of the first connector.
Figure 1D:
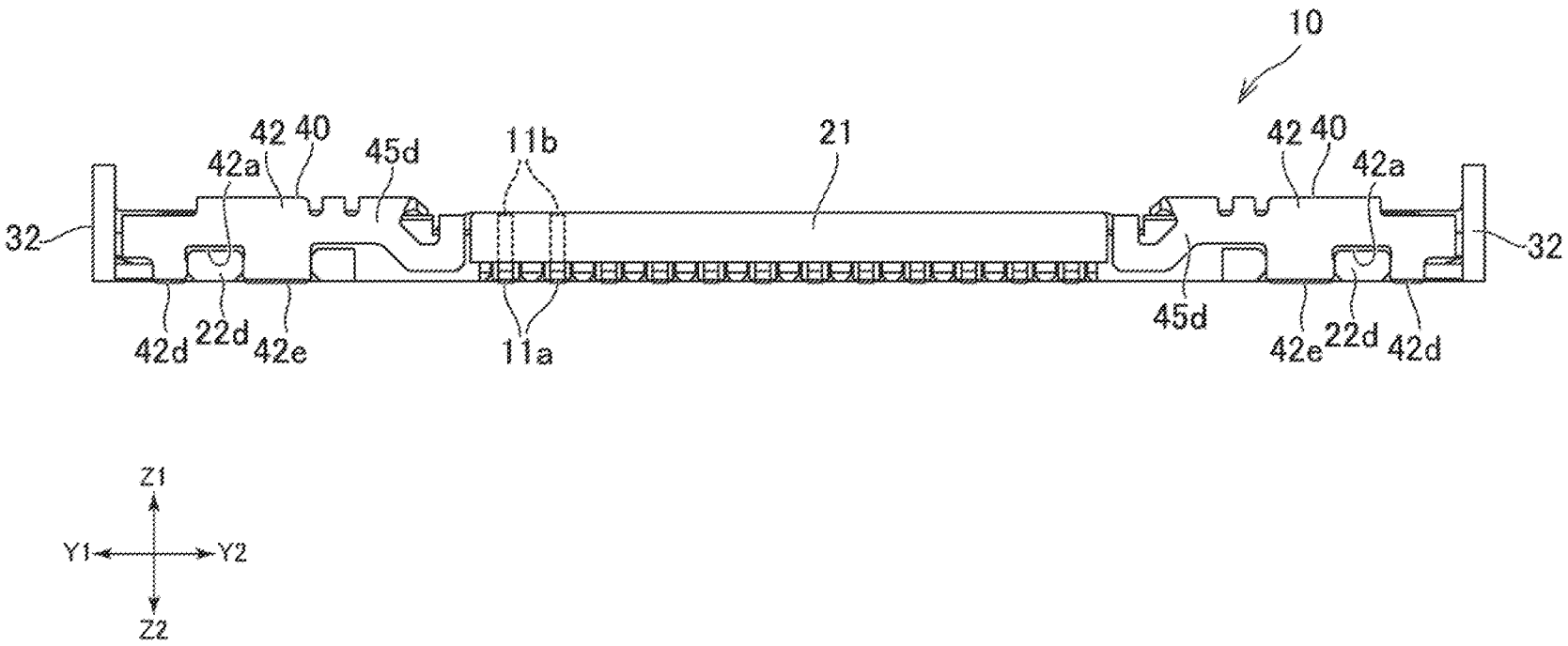
FIG. 1D is a side surface view illustrating a side surface of the first connector.
Figure 1E:
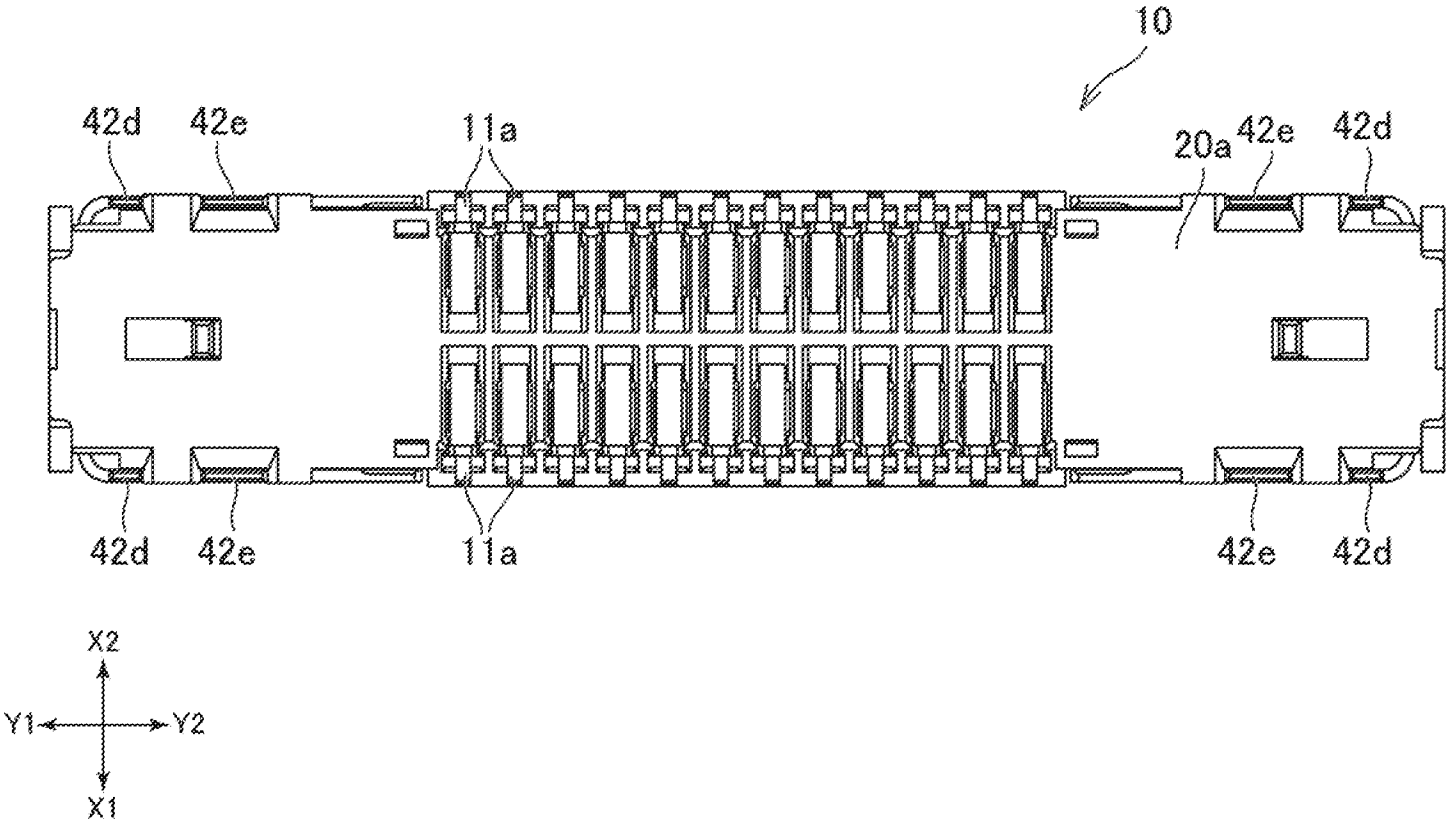
FIG. 1E is a bottom surface view illustrating the lower surface of the first connector.

Each first terminal 11 is, for example, a member formed by punching and bending a metal plate. The first terminal 11 includes a board connecting part 11*a* (refer to FIG. 1B) connected to the circuit board, a securing part 11*b* (refer to FIGS. 1C and 1D) engaged with the first housing 20, and a connection part 11*c* that is elastically deformable and electrically connects to a second terminal 61 of the plug connector 60. The connecting part 11*c* has a substantially U-shape opening upward, and the second terminal 61 of the plug connector 60 may be connected to the inside thereof. Herein, the phrase "the securing part 11*b* is engaged with the first housing 20" means that the securing part 11*b* is caught by a part of the first housing 20 and the position is secured to the first housing 20.

The first housing 20 is integrally formed of an insulating material such as a synthetic resin and has a substantially rectangular parallelepiped shape. Specifically, the first housing 20 has a lower surface 20*a* (FIG. 1B) of the bottom wall and a pair of first wall parts 21 (illustrated in FIG. 1A) extending in the longitudinal direction of the connector and opposing in the lateral direction of the connector. Further, the first housing 20 includes a pair of second wall parts 22 (refer to FIG. 3A) which are respectively positioned at both end parts of the first wall part 21 and opposed in the longitudinal direction of the connector. The second wall parts 22 are connected to the end parts of the two first wall parts 21, and the lower ends of the first wall parts 21 are connected to the lower surface 02*a*. The first housing 20 has a recessed part E1 into which the plug connector 60 is mated, inside the lower surface 20*a*, the two first wall parts 21, and the two second wall parts 22. The first housing 20 may have a center protrusion 23 protruding upward from the lower surface 20*a* and extending in the longitudinal direction of the connector at a center of the recess E1.

The plurality of first terminals 11 are held by the first wall part 21. In the example of the receptacle connector 10, the plurality of first terminals 11 are arranged between one first wall part 21 and the center protrusion 23, and between the other first wall part 21 and the center protrusion 23. A plurality of grooves aligned in the longitudinal direction may be formed on the inner wall side of the first wall part 21 and the side wall side of the center protrusion 23. The connecting part 11*c* of the first terminal 11 may be positioned in the groove formed in the first wall part 21 and in the groove of the center protrusion 23. The board connecting part 11*a* of the first terminal 11 is located under the first wall part 21 and extends to the outside in the lateral direction of the connector (refer to FIG. 1B). The securing part 11*b* of the first terminal 11 extends upward from the board connecting part 11*a*, and the upper end 11*d* thereof is connected to the connecting part 11*c* (refer to FIG. 1A). The secured part 11*b* is held by the first wall part 21.

The shape of the first housing 20 and the shape of the first terminal 11 are not limited to the examples of the connector assembly 1 of the present disclosure. For example, if the first housing 20 does not have the center protrusion 23, the first terminal 11 may be held by the first wall part 21.

The first securing metal fitting 40 is, for example, a member formed by punching and bending from a metal plate. The first securing metal fitting 40 is mounted on the second wall part 22 of the first housing 20. As illustrated in FIG. 3A, the first securing metal fitting 40 includes a top plate part 41 and a metal fitting side part 40S as an engaging mechanism part, directly or indirectly extending from the edge of the top plate part 41 in the short direction of connector. In addition, the metal fitting side part 40S may include a hook (engaging part) 43 that elastically contacts the slider 30, and an engaging part 42 engaging with the first housing 20. Herein, the phrase "the engaging part 42 is engaged with the first housing 20" means that a part of the engaging part 42 is caught by the first housing 20 and the engaging part 42 is in a state attached to the first housing 20 (In other words, a secured state). Further, the metal fitting side part 40S has securing parts 42*d*, 42*e* (refer to FIG. 1B) connected to the circuit board, and a terminal part 45*a* that is in electrical contact with the second terminal 61 or the third terminal 62 of the plug connector 60. In the case where the metal fitting side part 40S includes the securing parts 42*d* and 42*e*, the receptacle connector 10 can be firmly attached to the circuit board. Further, when the metal fitting side part 40S includes the terminal part 45*a*, the first securing metal fitting 40 and the terminals 61, 62 of the plug connector 60 can be electrically connected. As a result, it is possible to reduce the number of components and the size of the connector.

Slider

Figure 6A:
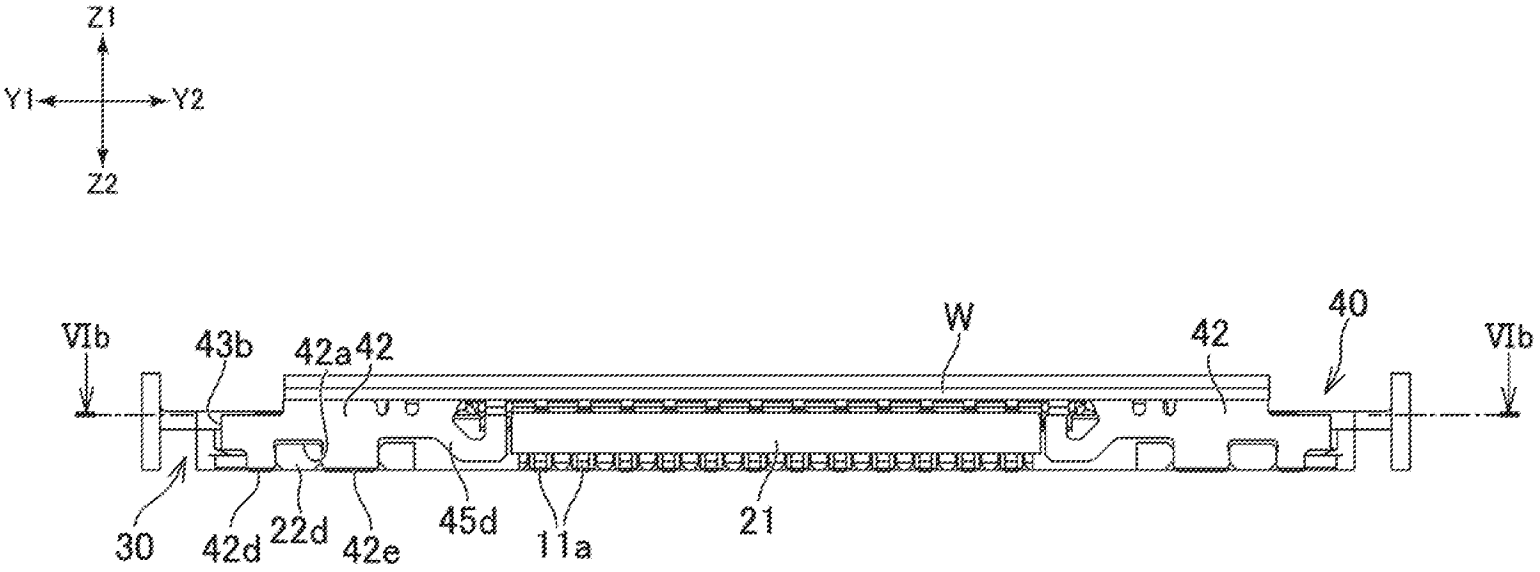
FIG. 6A is a side view illustrating a state in which the connector assembly is unlocked.
Figure 6C:
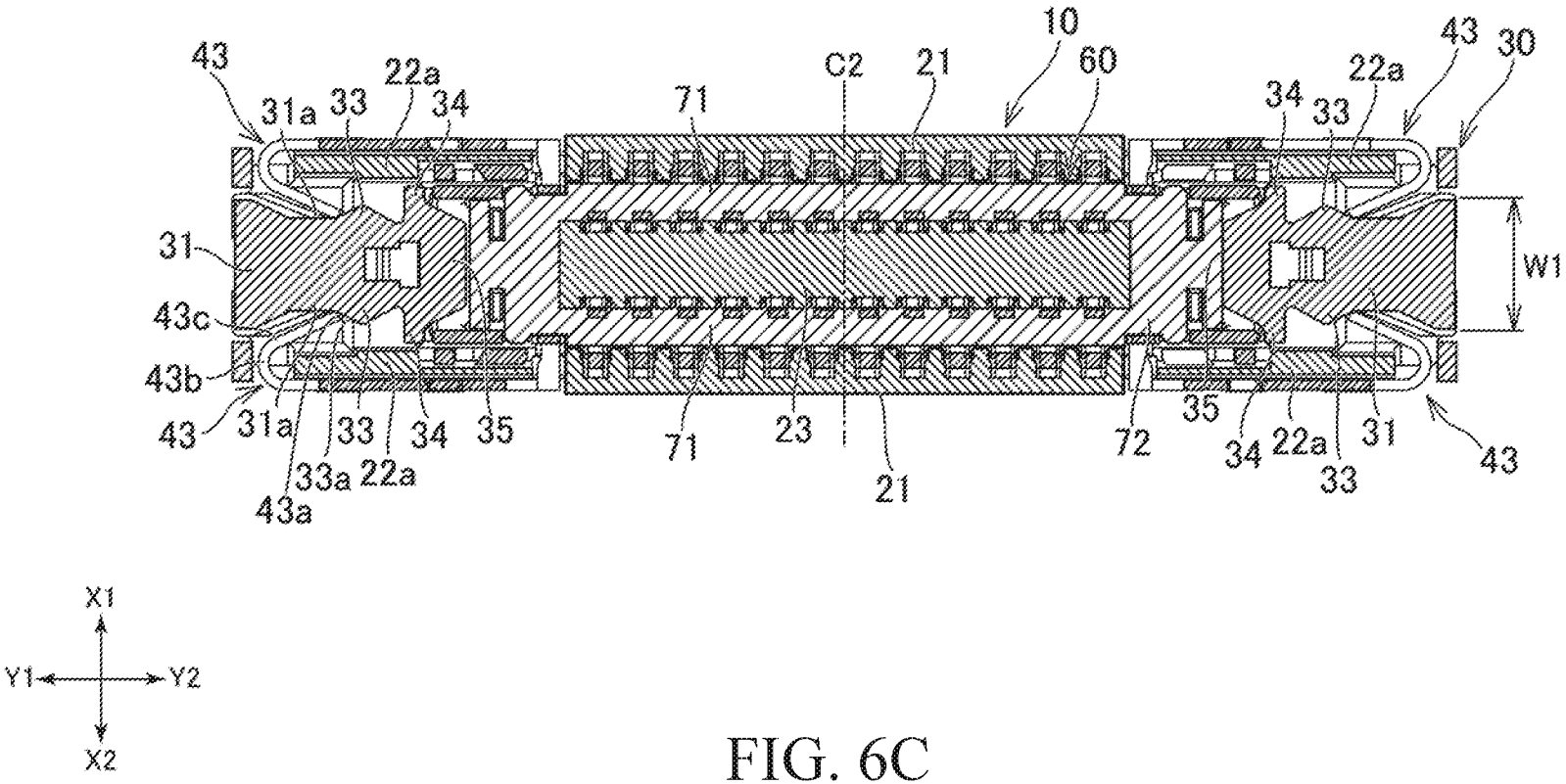
FIG. 6C is a cross-sectional view illustrating the locked state of the connector along line VIb-VIb in FIG. 6A.
Figure 7A:
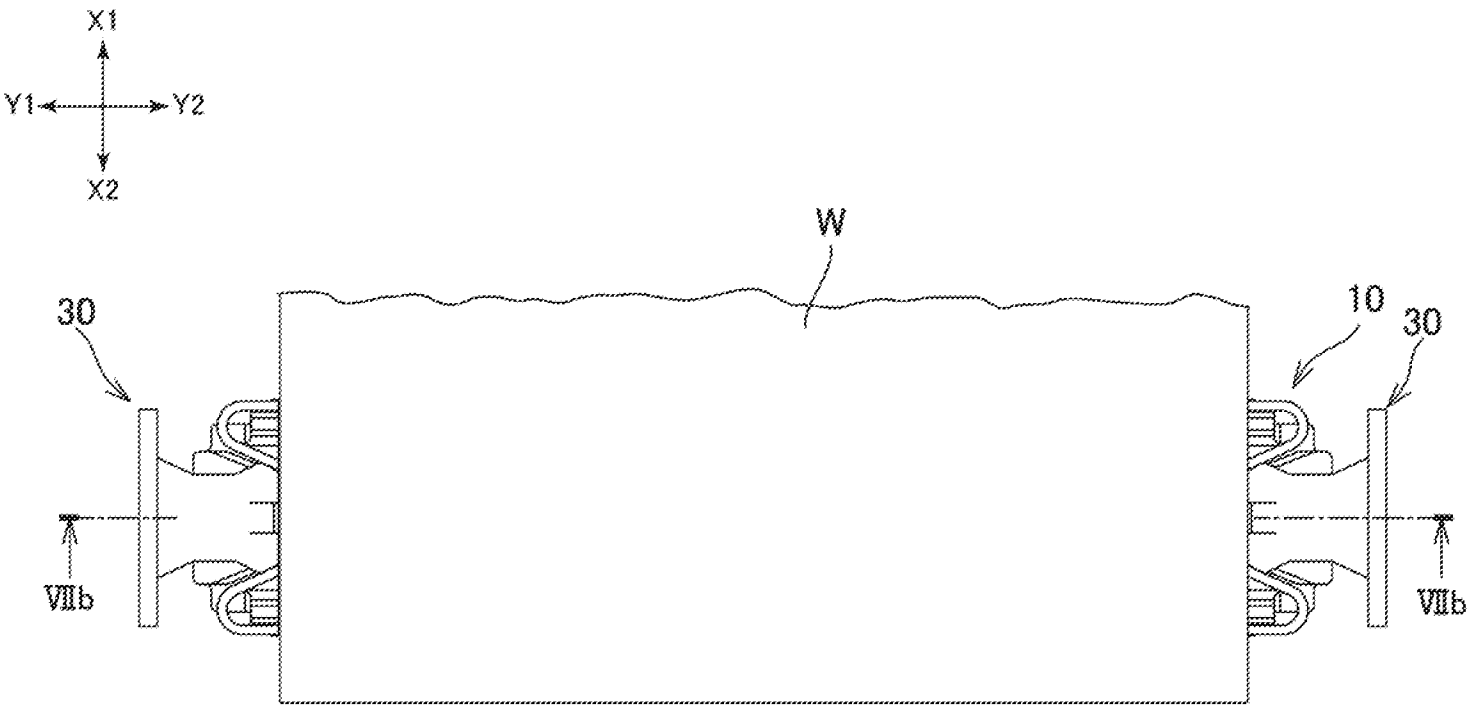
FIG. 7A is a plan view illustrating a state in which the connector assembly is unlocked.
Figure 7B:
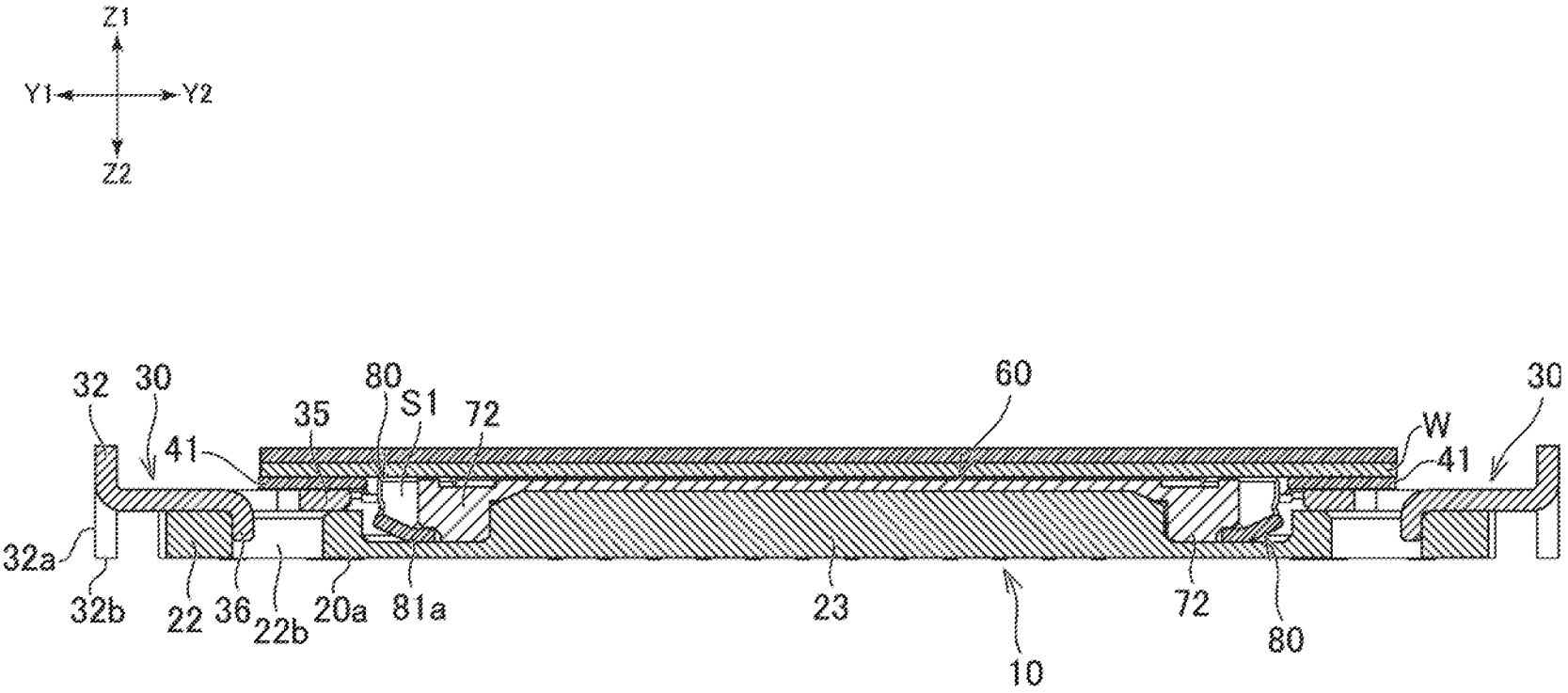
FIG. 7B is a cross-sectional view illustrating the unlocked state of the connector along line VIIb-VIIb in FIG. 7A.

The slider 30 is a member formed by punching and bending a metal plate. The slider 30 is attached to the second wall part 22 of the first housing 20. As illustrated in FIG. 3A, the slider 30 may include a flat plate part 31 extending in the longitudinal direction of the receptacle connector 10 and an operating part 32 for the operator to insert and remove the slider 30. At least one first engageable part 33 that can engage with the hook 43 of the first securing metal fitting 40 is formed at both end edges of the flat plate part 31 in the lateral direction of the receptacle connector 10, and at least one second engageable part 34 may be formed on each of both end edges of the flat plate part 31 (refer to FIG. 6C). The first engageable part 33 and the second engageable part 34 are disposed, for example, in the longitudinal direction with respect to one side edge of the flat plate part 31 and may be disposed in tandem. The flat plate part 31 is provided with a locking part 35 for locking the second connector 60 at the tip thereof. As illustrated in FIG. 7B, the flat plate part 31 of the slider 30 has a lower surface opposed to the upper surface of the second wall part 22 of the first housing 20, and an upper surface that can be disposed to be opposed to the lower surface of the top plate part 41 of the first securing metal fitting 40. The slider 30 is slideably disposed in the longitudinal direction of the connector.

Figure 5A:
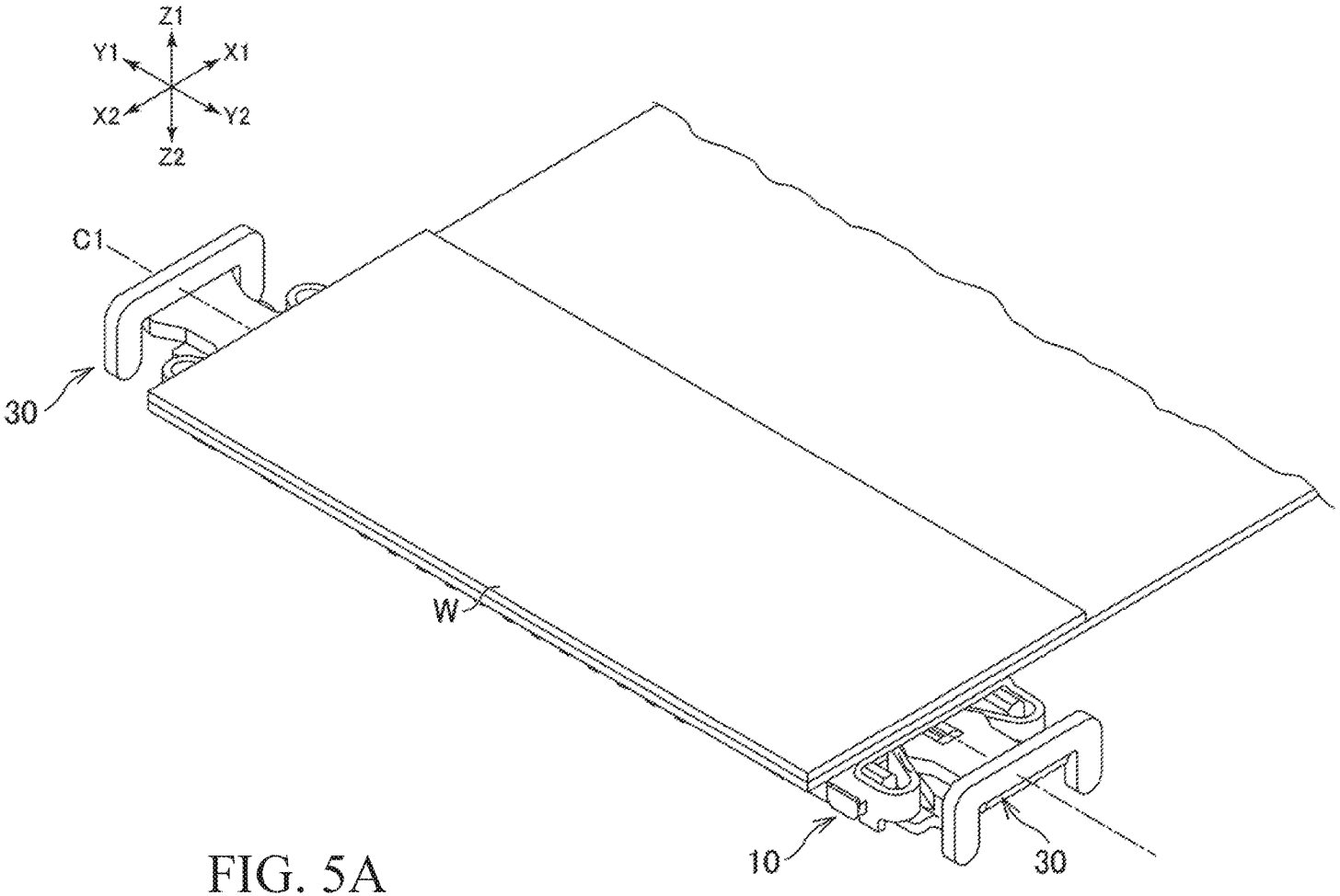
FIG. 5A is a perspective view illustrating a state in which the connector assembly is unlocked.
Figure 5B:
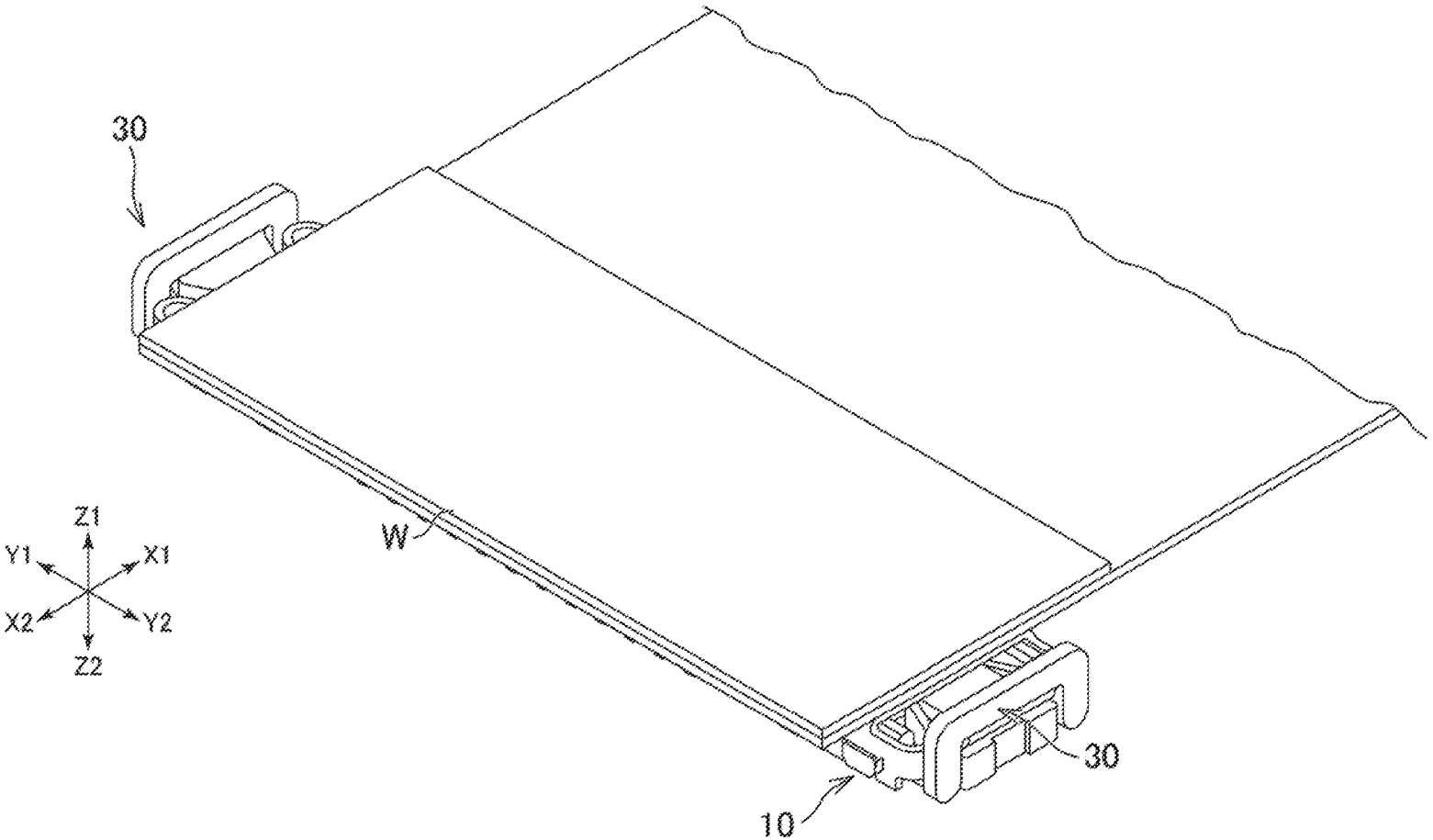
FIG. 5B is a perspective view illustrating a locked state of the connector assembly.

As described above, in the example of the receptacle connector 10, the slider 30 has a plate shape. In other words, the slider 30 has a flat plate part 31. The flat plate part 31 is disposed such that the thickness is in the height direction (Z1-Z2 direction) of the receptacle connector 10. Because of the shape of the slider 30, the width of the locking part 35 can be increased. As a result, it is possible to more effectively suppress movement of the plug connector 60 which is the second connector with respect to the receptacle connector 10. In other words, movement of the second connector 60 around a center line C1 (refer to FIG. 5A) along the longitudinal direction of the connector can be suppressed. In this specification, a plate-like slider refers to a slider in which the width W1 (refer to FIG. 6C) of the flat plate part 31 is larger than the thickness H1 (refer to FIG. 7B).

Figure 6B:
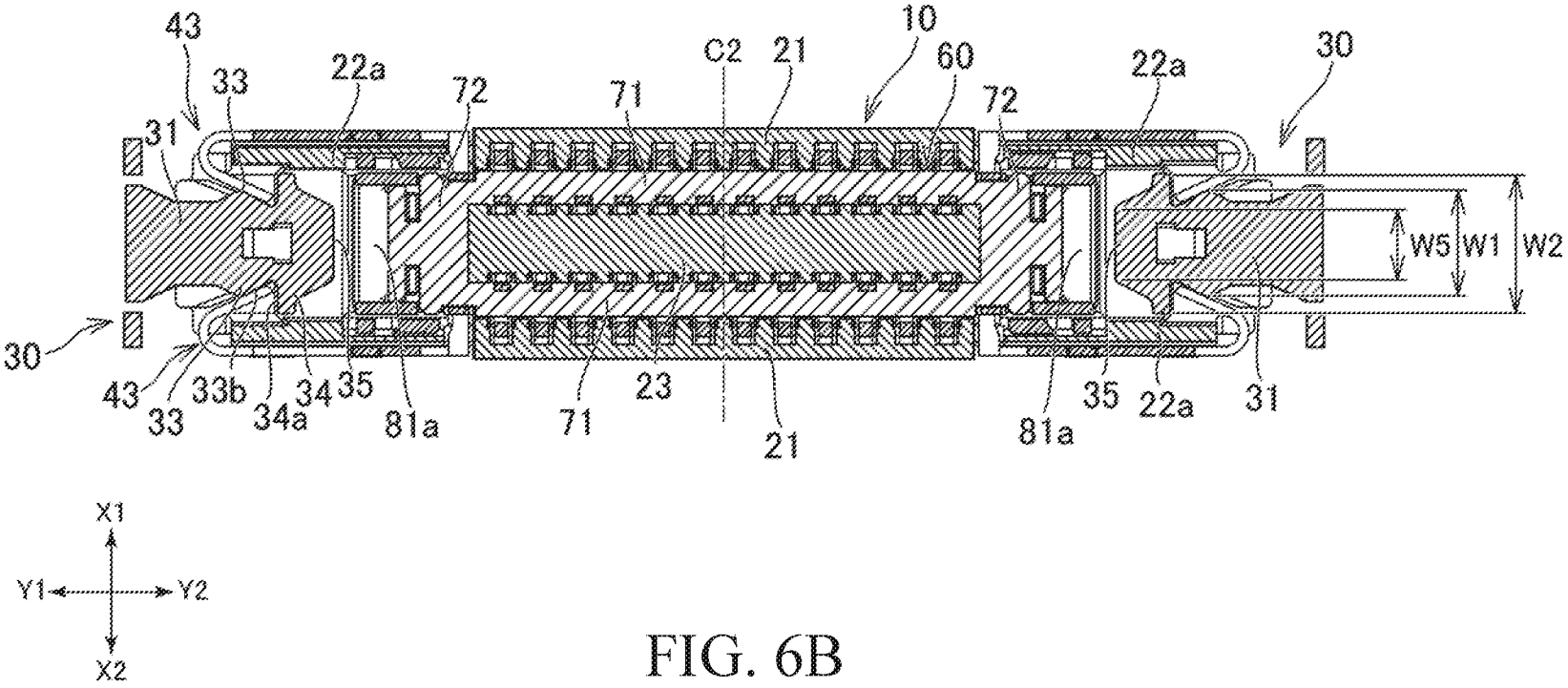
FIG. 6B is a cross-sectional view illustrating the unlocked state of the connector along line VIb-VIb in FIG. 6A.

The slider 30 is supported by the second wall part 22 of the first housing 20 and is able to slide in the longitudinal direction. Specifically, the slider 30 is able to slide in the longitudinal direction between the lock position (refer to FIG. 7C) and the lock release position (refer to FIG. 7B). In the example of the receptacle connector 10, the slider 30 is disposed on an upper side of the second wall part 22. As illustrated in FIG. 6B, the second wall part 22 has two guide wall parts 22*a* opposing in the lateral direction of the connector on the upper surface thereof. The guide wall part 22*a* is disposed at an end part in the short side direction and extends in the longitudinal direction of the receptacle connector 10. The slider 30 is disposed between the two guide wall parts 22*a*. An edge of the slider 30 may contact the guide wall part 22*a* or may not contact the guide wall part 22*a*.

Figure 7C:
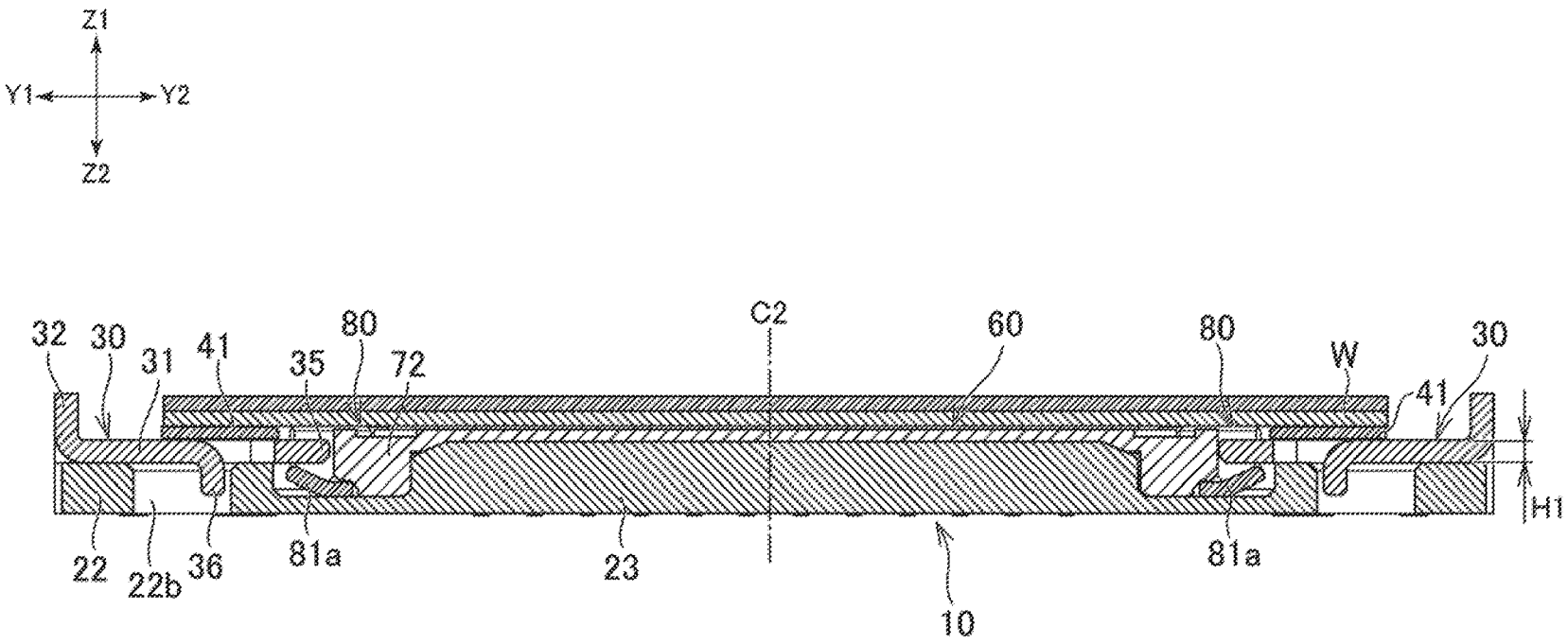
FIG. 7C is a cross-sectional view illustrating the state of locking of the connector along line VIIb-VIIb in FIG. 7A.

As illustrated in FIG. 7C, the slider 30 locks the plug connector 60 that is mated inside the recess E1 of the first housing 20 when in the locked position. Herein, the phrase "the slider 30 locks the plug connector 60" means that a part of the slider 30 is positioned above a part of the plug connector 60. In other words, a part of the slider 30 is positioned in a direction where the plug connector 60 disconnects relative to a part of the plug connector 60. The slider 30 may contact the plug connector 60 or may not contact the plug connector 60. In the example of the receptacle connector 10, the slider 30 has a locking part 35 at a tip (end facing inward in the longitudinal direction) (in the present specification, "a direction facing inward in the longitudinal direction" is, for example, as illustrated in FIG. 7, a direction facing the center C2 in the longitudinal direction.) The plug connector 60 has a second securing metal fitting 80 at an end part in the longitudinal direction, as described below. When the slider 30 is in the locked position, the locking part 35 engages with the second securing metal fitting 80 to lock the plug connector 60. That is, the locking part 35 restricts the separation of the plug connector 60 from the receptacle connector 10. The phrase "the locking part 35 is engaged with the second securing metal fitting 80" means that the locking part 35 is positioned above a part of the securing metal fitting 80. In other words, the locking part 35 is positioned in the direction in which the plug connector 60 disconnects with respect to a part of the second securing metal fitting 80. The locking part 35 may contact the second securing metal fitting 80 or may not contact the second securing metal fitting 80. In the example of the plug connector 60, the second securing metal fitting 80 has a plate-shaped overhang part 81*a* (refer to FIG. 2B) protruding outward in the longitudinal direction of the connector. As illustrated in FIG. 7C, when the slider 30 is in the locked position, the locking part 35 is positioned above the overhang part 81*a*, and the upward movement of the plug connector 60 (movement in the disengaging direction of the plug connector 60) is controlled. The engagement between the locking part 35 and the plug connector 60 is not limited to the case using the overhang part 81*a*. For example, the housing 70 of the plug connector 60 may have a recessed part into which the protruding part or the locking part 35 mates.

As illustrated in FIG. 7B, the slider 30 is separated from the plug connector 60 disposed inside the recess E1 of the first housing 20 when in the unlocked position. In the example of the connector assembly 1, the locking part 35 retracts to the outside in the longitudinal direction from the space S1 above the overhang part 81*a*. As a result, the plug connector 60 is unlocked. That is, the locking part 35 allows separation of the plug connector 60 from the receptacle connector 10.

First Engaged Part and Hook

As described above, the slider 30 may have the first engageable part 33. In addition, the first securing metal fitting 40 may have a hook 43. As illustrated in FIG. 6C, when the slider 30 is in the locked position, the hook 43 engages with the first engageable part 33 and restricts the movement of the slider 30 from the locked position to the unlocked position. Herein, "the hook 43 engages with the first engageable part 33" means that a part of the hook 43 is positioned outward in the longitudinal direction of the receptacle connector 10 with respect to the first engageable part 33, and a part of the hook 43 contacts the first engageable part 33 when the slider 30 moves outward in the longitudinal direction. When the slider 30 is inserted deepest toward the center in the longitudinal direction, the hook 43 does not necessarily contact the first engageable part 33. The hook 43 is elastically deformable, and the slider 30 is allowed to move between the locked position and the unlocked position by the elastic deformation of the hook 43. With this receptacle connector 10, by disposing the slider 30 in the locked position, the movement of the plug connector 60 with respect to the receptacle connector 10 is suppressed, and the stability of the electrical connection therebetween can be improved. Also, it is possible to prevent the operator from inadvertently moving the slider 30 from the locked position to the unlocked position by the hook 43.

As illustrated in FIG. 6C, the first engageable part 33 may be formed on an edge 31*a* of the slider 30. More specifically, the flat plate part 31 has two edges 31*a* positioned on opposite sides in the lateral direction of the connector, and the first engageable part 33 may be formed on each of the two edges 31*a*. The first engageable part 33 may be a convex part protruding in the lateral direction from the edge 31*a*. In addition, the edge of the convex part may include an inclined part extending outward in the lateral direction and an inclined part extending inward in the lateral direction.

As illustrated in FIG. 6C, the hook 43 may be positioned outside the slider 30 in the lateral direction of the connector and may face the edge 31*a* of the flat plate part 31. In the example of the receptacle connector 10, the first securing metal fitting 40 includes two hooks 43 positioned on opposite sides in the short direction of the connector. The slider 30 may be disposed between the two hooks 43. That is, the two hooks 43 may sandwich the slider 30 in the lateral direction of the connector. Each hook 43 is elastically deformable in the lateral direction of the connector. More specifically, the hooks 43 have a base part 43*b* and a board spring-like extending part 43*c* extending from the base part 43*b*. The extending part 43*c* extends diagonally from the base part 43*b* toward the edge 31*a* of the slider 30. In the example of the receptacle connector 10, the extending part 43*c* extends diagonally from the base part 43*b* toward the edge 31*a* of the slider 30 and toward the inner side in the longitudinal direction of the connector. The hook 43 may be elastically deformable so that the extending part 43*c* moves in the lateral direction of the connector, centering the base part 43*b*.

As illustrated in FIG. 6C, when the slider 30 is in the locked position, the end part 43*a* (the end part of the extending part 43*c*) of the hook 43 contacts the first engageable part 33 of the slider 30, and regulates sliding from the locked position to the unlocked position of the slider 30. More specifically, when the slider 30 is in the locked position, the first engageable part 33 is located inside the extended part 43*c* in the longitudinal direction. The end part 43*a* of the hook 43 contacts the outer edge 33*a* in the longitudinal direction of the first engageable part 33. Since the end part 43*a* of the hook 43 contacts the first engageable part 33 as described above, sliding of the slider 30 from the locked position to the unlocked position can be effectively restricted. When the slider 30 is in the locked position, the end 43*a* of the hook 43 does not necessarily have to contact the first engageable part 33. When the slider 30 attempts to move toward the unlocked position, the end part 43*a* of the hook 43 may contact the first engageable part 33.

When the hook 43 is elastically deformed and the extending part 43*c* moves toward the outside in the lateral direction of the connector, sliding of the slider 30 from the locked position to the unlocked position is permitted. As illustrated in FIG. 6C, the edge 33*a* of the first engageable part 33, that the end part 43*a* of the hook 43 contacts, may be inclined. In particular, the edge 33*a* may extend inwardly in the longitudinal direction of the connector and outwardly and diagonally in the lateral direction. According to this, when a force pulling the slider 30 toward the unlocking position acts, the end part 43*a* of the hook 43 moves along the edge 33*a*, and the hook 43 naturally elastically deforms.

As illustrated in FIG. 6B, when the slider 30 is in the unlocked position, the end part 43*a* of the hook 43 is located inside the first engageable part 33 of the slider 30 in the longitudinal direction, and the first engageable part 33 is brought into contact with the extending part 43*c*. When the hook 43 is elastically deformed and the extended part 43*c* of the hook 43 moves outward in the lateral direction of the connector, the slider 30 is allowed to slide from the lock release position to the lock position. When a force pushing the slider 30 toward the locking position acts, the extending part 43*c* is pushed toward the outside in the lateral direction of the connector by the first engageable part 33, and elastic deformation of the hook 43 occurs. The edge 33*b* (the edge on the center C2 in the longitudinal direction) of the first engageable part 33 may also be inclined. The extending part 43*c* of the hook 43 may contact the edge 33*b* of the first engageable part 33. The slider 30 may be sandwiched between two extending parts 43*c*. Thereby, rattling of the slider 30 can be suppressed.

As described above, in the example of the receptacle connector 10, the extending part 43*c* of the hook 43 extends diagonally from the base part 43*b* toward the inside in the longitudinal direction of the connector. With this hook 43, the force required to move the slider 30 toward the unlocked position can be made larger than the force required to move the slider 30 toward the locked position.

In addition, the receptacle connector 10 has two hooks 43 positioned on opposite sides of the slider 30. Therefore, for example, the position of the slider 30 in the lateral direction of the connector can be guided by the hooks 43.

As described above, the first securing metal fitting 40 may have the engaging part 42 secured to the first housing 20. As illustrated in FIGS. 1A and 6A, the engaging part 42 may be secured to the side surface of the second wall part 22 of the first housing 20 (the surface facing outward in the lateral direction of the connector). The base part 43*b* of the hook 43 may be connected to the engaging part 42. More specifically, the engaging part 42 has a wall shape disposed along the side surface of the second wall part 22. The base part 43*b* of the hook 43 may be connected to the end part of the engaging part 42 (the end part on the outer side in the longitudinal direction of the connector). The hook 43 may be bent at the base part 43*b* and extend inward in the longitudinal direction of the connector. With this structure of the first securing metal fitting 40, since the distance between the base part 43*b* and the engaging part 42 is small, the engaging part 42 can be used to suppress the movement of the position of the base part 43*b* due to the force the hook 43 receives.

As illustrated in FIGS. 3A and 6A, a recess 42*a* may be formed in the engaging part 42. On the other hand, the second wall part 22 may have a protruding part 22*d* to be mated into the recess 42*a*. A claw is formed on the inner edge of the recess 42*a*, and this claw may be caught by the protrusion 22*d*. The securing structure between the engaging part 42 and the second wall part 22 may be appropriately changed.

As described above, the metal fitting part 40S of the first securing metal fitting 40 may have the securing parts 42*d*, 42*e* connected to the circuit board. As illustrated in FIG. 6A, the lower edge of the engaging part 42 may function as the securing parts 42*d* and 42*e*. The securing parts 42*d* and 42*e* are located below the lower surface 20*a* of the first housing 20. The engaging part 42 has two securing parts 42*d* and 42*e* positioned on opposite sides of the recess 42*a*. With this structure, it is possible to more effectively suppress the position of the base part 43*b* from moving due to the force applied to the hook 43.

The structure of the first engageable part 33 and the hook 43 is not limited to the example of the receptacle connector 10. For example, the hook 43 may be formed on the top plate part 41 of the first securing metal fitting 40. In this case, the first engageable part 33 may be a convex part protruding upward from the flat plate part 31 of the slider 30. As yet another example, when the slider 30 is in the locked position, the first engageable part 33 does not have to contact the end part 43*a* of the hook 43. For example, the hook 43 may have an extending part extending further inward in the longitudinal direction from the extending part 43*c* and further outward in the lateral direction. Furthermore, the first engageable part 33 may contact the extended part. As yet another example, the base part 43*b* may be located further to the inner side in the longitudinal direction of the connector than the extending part 43*c*. In this case, the extending part 43*c* may extend diagonally from the base part 43*b* toward the outside in the longitudinal direction and toward the edge 31*a* of the slider 30.

Second Engageable Part and Hook

As illustrated in FIG. 6B, the slider 30 may have a second engageable part 34. When the slider 30 is in the unlocking position, the hook 43 engages with the second engageable part 34 and controls further movement of the slider 30 from the unlocked position of the slider 30 toward the outside in the longitudinal direction. That is, the second engageable part 34 limits the slider 30 from disconnecting from the receptacle connector 10. Herein, "the hook 43 is engaged with the second engageable part 34" means that a part of the hook 43 is positioned on the outer side in the longitudinal direction of the receptacle connector 10 with respect to the second engageable part 34, and a part of the hook 43 contacts the second engageable part 34 when the slider 30 moves outward in the longitudinal direction. When the slider 30 is located at the outermost position in the longitudinal direction, the hook 43 does not have to contact the second engageable part 34.

In the example of the receptacle connector 10, similar to the first engageable part 33, the second engageable part 34 may be formed on the edge 31*a* of the slider 30 (flat plate part 31). The second engageable part 34 may be formed on each of the two edges 31*a*. The second engageable part 34 may be a convex part protruding in the lateral direction. The convex part may have a shape extending outward in the lateral direction. The second engageable part 34 is located inside the first engageable part 33 in the longitudinal direction. In other words, the second engageable part 34 is located closer to the locking part 35 at the distal end of the slider 30 than the first engageable part 33.

When the slider 30 is in the unlocked position, the end part 43*a* of the hook 43 contacts the second engageable part 34. More specifically, when the slider 30 is in the unlocked position, the extending part 43*c* of the hook 43 is located outside the second engageable part 34 in the longitudinal direction. The end part 43*a* of the hook 43 contacts the edge 34*a* (the outer edge in the longitudinal direction) of the second engageable part 34.

The protrusion amount (the length in the lateral direction) of the protruding part of the second engageable part 34 may be larger than the protrusion amount of the protruding part of the first engageable part 33. Thereby, it is possible to more reliably maintain the engagement between the second engageable part 34 and the hook 43.

Further, as illustrated in FIG. 6B, the width W2 of the slider 30 at the position of the second engageable part 34 can be larger than the width W1 of the slider 30 at the position of the first engageable part 33. The width W2 of the slider 30 at the position of the second engageable part 34 may be larger than the width W5 of the locking part 35 of the slider 30. In the example of the receptacle connector 10, the top plate part 41 of the first securing metal fitting 40 is positioned above the slider 30. When a force pulling the plug connector 60 upward acts while the slider 30 is in the locked position, the slider 30 may also be pulled up and contact the top plate part 41 of the first securing metal fitting 40. It is possible to suppress bending of the top plate part 41 when the slider 30 contacts the top plate part 41 by increasing the width W2 of the second engageable part 34. In other words, the upward movement of the slider 30 can be suppressed more reliably by the top plate part 41, and the slider 30 can be prevented from disconnecting from the receptacle connector 10. As a result, engagement between the slider 30 and the plug connector 60 can be more reliably maintained.

Part to be Locked and Locking Hole

Further, as illustrated in FIG. 7B, the slider 30 may have a part to be locked 36. When the slider 30 is in the unlocked position, the part to be locked 36 contacts the first housing 20. The part to be locked 36 restricts the slider 30 from further moving outward from the lock release position toward the outside in the longitudinal direction of the connector. In other words, similar to the second engageable part 34, the part to be locked 36 also restricts the slider 30 from disconnecting from the connector 10.

As illustrated in FIG. 7B, the part to be locked 36 may be formed in the flat plate part 31. Particularly, a part of the flat plate part 31 (in the example of the slider 30, the center part of the flat plate part 31) is bent downward, and a part of that may function as the part to be locked 36. A locking hole 22*b* opening upward may be formed in the second wall part 22 of the first housing 20. The part to be locked 36 is placed in the locking hole 22*b* and may move longitudinally within the locking hole 22*b* as the slider 30 slides. When the slider 30 is in the unlocked position, the part to be locked 36 contacts the inner surface (the surface located outside in the longitudinal direction) of the locking hole 22*b* and restricts the movement of the slider 30 in the longitudinal direction.

The position and shape of the part to be locked 36 is not limited to the example of the receptacle connector 10. For example, the part to be locked 36 may be formed on the edge 31*a* of the flat plate part 31, and the second wall part 22 may be formed with the locking hole at a position corresponding to the part to be locked 36. In yet another example, the part to be locked 36 may be a hole formed in the flat plate part 31. In this case, a convex part mated into this hole may be formed as a locking part on the upper surface side of the second wall part 22. In yet another example, the slider 30 may not have the part to be locked 36.

Operating Part

As illustrated in FIG. 3A, the slider 30 may have an operation section 32. The operation part 32 is formed at the end part (the outer end part in the longitudinal direction) of the flat plate part 31. The operating part 32 is located outside in the longitudinal direction with respect to the second wall part 22 of the first housing 20 (refer to FIG. 7B). As a result, an operator can slide the slider 30 by pushing or pulling the operating part 32. The operating part 32 may have a downwardly extending part 32*a* (refer to FIG. 3A) (hereinafter this part 32*a* is referred to as "supporting part"). As illustrated in FIG. 7B, the support part 32*a* may be positioned lower than the flat plate part 31 disposed on the second wall part 22. With this shape of operating part 32, when a force to push down the operating part 32 is subjected, the supporting part 32*a* contacts the circuit board on which the receptacle connector 10 is mounted, and the operating part 32 can be supported. The lower end 32*b* of the supporting part 32*a* may be located at substantially the same height as the lower surface 20*a* of the first housing 20. Unlike the example of the receptacle connector 10, the position of the lower end 32*b* of the supporting part 32*a* may be higher than the lower surface 20*a* of the first housing 20.

In the example of the receptacle connector 10, the operating part 32 is bent upward with respect to the flat plate part 31. The operating part 32 has support parts 32*a* at both end parts of the operating part 32 in the lateral direction of the connector. The shape of the operating part 32 is not limited to the example of the slider 30. For example, the operating part 32 may be bent downward with respect to the flat plate part 31 and may function as the aforementioned supporting part. In yet another example, the operating part 32 may similarly be formed at the outer end of the flat plate section 31 in the lateral direction of the slider 30. In yet another example, the operating part 32 does not necessarily have the supporting part 32*a*.

First Securing Metal Fitting

As described above, the first securing metal fitting 40 can have two metal fitting side parts 40S. As illustrated in FIG. 3A, the two metal fitting side parts 40S are placed on mutually opposing sides in the transverse direction while sandwiching the slider 30. The first securing metal fitting 40 can have a part that connects the two metal fitting side parts 40S. Thereby, the number of parts for the receptacle connector 10 can be reduced. In the example of the receptacle connecter 10, the first securing metal fitting 40 has the aforementioned top plate part 41. The top plate part 41 is placed between the two metal fitting side parts 40S, and connects the two metal fitting side parts. In particular, each metal fitting side part 40S can have an engaging part 42. The top plate part 41 can be positioned between the upper edges of the two engaging parts 42, and can connect the two engaging parts 42.

As illustrated in FIG. 7B and FIG. 7C, the top plate part 41 can be placed on the upper side of the slider 30. The slider 30 can slide between the upper surface of a second wall part 22 of the first housing 20 and the top plate part 41. With this configuration, for example, compared to a structure in which a through hole is formed in order to insert the slider 30 in the second wall 22, manufacturing of the receptacle connector 10 can be simplified and shortened.

As illustrated in FIG. 7B and FIG. 7C, a gap between the upper surface of the second wall part 22 and the lower surface of the top plate part 41 can substantially correspond to the thickness of the slider 30. With this configuration, movement of the slider 30 can be guided by the top plate part 41. In other words, tilting of the slider 30 upwards or downwards can be suppressed.

The configuration of the first secured metal fitting 40 is not restricted to the receptacle connector 10 for example. For example, the two metal fitting side parts 40S do not have to be connected by passing through the top plate part 41. In this case, the receptacle connector 10 can have two first securing metal fittings 40 that are positioned on opposing sides while sandwiching the slider 30. One hook 43 and one engaging part 42 can be provided for each of the first securing metal fittings 40. In this case, the top plate part 41 of each of the first securing metal fittings 40 can cover only one part of the upper side of the slider 30, or can use a top plate member with a different form than the metal fitting side part 40. For example, the top plate part 41 is only placed on the upper side of an edge 31*a* or the engageable parts 33 and 34 of the slider 30, and is not necessarily placed on the upper side of the center part of the slider 30.

The metal fitting side part 40S can have a terminal part 45*a*, a guide part 45*b*, and a held part 45*c*. As illustrated in FIG. 1A and FIG. 3A, the metal fitting side part 40S can also have an arm part 45*d*. The arm part 45*d* is disposed along the outside of the first wall part 21, and extends towards the inside in the longitudinal direction from the engaging member 42. The arm part 45*d* can be elastically deformable in order to widen to the outside of the connector in the traverse direction. The terminal part 45*a*, the guide part 45*b*, and the maintained part 45*c* all extend towards the inside in the traverse direction from the arm part 45*d*, and the direction is positioned towards the inside of a recessed part E1 of the first housing 20 (the direction "facing the inside in the traverse direction" refers to a direction facing the center line C1 in the traverse direction.).

The terminal part 45*a* extends from the arm part 45*d* to the inside of the first wall part 21, and curves to the lower side. When the two connectors 10 and 60 are in an interlocked condition, the terminal part 45*a* is connected to a terminal 62 of the plug connector 60 (refer to FIG. 3B). The terminal part 45*a* is elastically deformable, and is connected to the terminal 62 by the elastic force.

The guide part 45*b* extends from the arm part 45*d* to the inside of the first wall part 21 in a downward sloping direction. In the process in which the two connectors 10 and 60 are mated together, the guide part 45*b* corresponds to the second secured metal fitting 80 (described below) of the plug connector 60, and guides the plug connector 60 to a position that is suitable for the receptacle connector 10.

The held part 45*c* extends from the arm part 45*d* to the inside of the first wall part 21. The held part 45*c* mates with the concave part 21*c* formed on the inner surface of the first wall part 21 (refer to FIG. 3A), and is secured to the concave part 21*c*.

In the example for the receptacle connector 10, the terminal part 45*a*, the guide part 45*b*, and the held part 45*c* are arranged in order from the front end of the arm part 45*d*.

The configuration of the first secured metal fitting 40 is not restricted to the receptacle connector 10 for example. For example, the first securing metal fitting 40 does not necessarily have one portion or all of the arm part 45*d*, the terminal part 45*ba*, the guide part 45*b*, or the held part 45*c*.

Second Connector

As illustrated in FIG. 3B, the plug connector 60 has a second terminal 61 that connects a circuit board W (refer to FIG. 4) and the first terminal 11 of the receptacle connecter 10, and a second housing 70 that holds the second terminal 61. Furthermore, the plug connector 60 can also have a second securing metal fitting 80 that secures the second housing 70 to the circuit board.

Each of the second terminals 61 are, for example, members formed by a process of punching from a metal plate and a bending process. As illustrated in FIG. 3B, the second terminal 61 is engaged to a substrate connecting part 61*a* that connects to the circuit board and the second housing 70, and has an approximately U shaped connecting part 11*c* of the first terminal 11, and a connecting part 61*b* that is electrically connected. The phrase "the connecting part 61*b* is engaged to the second housing 70" means that the connecting part 61*b* is attached to the second housing 70 (secured on the second housing 70). Note, the plug connector 60 can include a third terminal 62 that is used as a grounding terminal. In this case, the third terminal 62 can be electrically or mechanically connected to the elastically deformable terminal part 45*a* of the first securing metal fitting 40.

As illustrated in FIG. 3B, the second housing 70 is integrally formed from an insulating material such as synthetic resin or the like, and has an approximately rectangular shape. Specifically, the second housing 70 extends towards the lower surface 70*a* of the bottom wall (refer to FIG. 2B) in the longitudinal direction of the connector, and has a pair of first wall parts 71 that are opposing in the traverse direction. Furthermore, the second housings 70 are placed on both end parts of the first wall part 71, and have a pair of second wall parts 72 that are opposing in the traverse direction. The second housing 70 has a concave part E2 on the lower surface 70*a* of the bottom wall and the inside of the first wall part 71 and the second wall part 72. As illustrated in FIG. 7B and FIG. 7C, the second housing 70 mates with the inside of the concave part E1 of the receptacle connector 10 when the connectors 10 and 60 are mated together. When doing so, a center protrusion 23 of the first housing 20 is mated to the inside of the concave part E2 of the second housing 70.

As illustrated in FIG. 3B, the plug connector 60 can have a plurality of second terminals 61 extending in the longitudinal direction. A plurality of second terminals 61 can be attached to the two first wall parts 71. The connecting part 61*b* of the second terminal 61 has an approximate U shape opening towards the lower part of the connecting part 61, the first wall part 71 is placed in the inside, and the second terminal 61 is secured on the first wall part 71. When the connector 10 and 60 are mated together, the connecting part 61*b* is mated to the inside of the connecting part 11*c* of the first terminal 11, and both are electrically connected. The substrate connecting part 61*a* of the second terminal 61 extends from the lower end of the connecting part 61*b* to the outside in the traverse direction of the connector.

As described above, the plug connector 60 can have a third terminal 62. In relation to the plurality of second terminals 61, the third terminal 62 can be disposed outside in the longitudinal direction of the connector, and secured on the first wall part 71 (refer to FIG. 2A). As illustrated in FIG. 3, the third terminal 62 can have the approximately U shaped connecting part 62*a* that opens downward. The first wall part 71 is mated to the inside of the connecting part 62*b*, and the third terminal 62 is secured to the first wall part 71. When the connectors 10 and 60 are mated together, the connecting part 62*b* is electrically connected to the terminal part 45*a* of the first securing metal fitting 40. The substrate connecting part 62*a* of the third terminal 62 extends from the lower end of the connecting part 62*b* to the outside in the traverse direction of the connector. Note, the second terminal 61 and the third terminal 62 can have different shapes as in the present disclosure, or can have the same shape. Furthermore, the second terminal 61 and the third terminal 62 can be mounted from the outside of the first wall part 71, or can be integrally formed with the first wall part 71 when forming the first wall part 71 and secured to the first wall part 71. The plug connector 60 can have a second securing metal fitting 80 that is mounted on the second wall part 72 of the second housing 70. In the example of the plug connector 60, the second securing metal fittings 80 are attached to each of the two second wall parts 72. The second securing metal fitting 80 is, for example, a member formed by a process of punching from a metal plate and a process of bending. As illustrated in FIG. 2A and FIG. 3B, the second securing metal fittings 80 can have a top plate part 81 that is disposed on the upper side of the second wall part 72.

The second securing metal fitting 80 can have a wall part 82 that extends downwards from the edge part of the top plate part 81 in the traverse direction of the connector. The second securing metal fitting 80 can have two wall parts 82 that are opposing in the traverse direction of the connector, and the second wall part 72 can be disposed between the two wall parts. The lower edge of the wall part 82 functions as a securing part 82 connected to the circuit board on which the plug connector 60 is mounted.

Furthermore, the second securing metal fitting 80 can have the engaging part 83 that extends downwards from the margin of the top plate part 81 (margin on the inside in the longitudinal direction) in the longitudinal direction of the connector. The engaging part 83 is engaged to the second wall part 82, and secures the second securing metal fitting 80 to the second housing 70. Herein, "the engaging part 83 is engaged to the second wall part 82" refers to the engaging part 82 being caught on a part of the second housing 70, and that position is secured to the second housing 70. In regards to the second securing metal fitting 80 in the example of the plug connector 60, two concave parts 72*a* that correspond to two engaging parts 83 are formed on the second wall part 72 of the second housing 70 that has two engaging parts 83 which are disposed separately in the traverse direction of the connector. The engaging part 83 mates with the concave part 72*a*, and is engaged to the second wall part 72. In particular, a tab 83*a* (reference FIG. 3A) is formed on the inside of the two engaging parts 83, and the tab 83*a* is caught on the inner surface of the concave part 72*a*. The secured structure of the second securing metal fitting 80 and the second housing 70 is not restricted to the example of the plug connector 60, and can be changed appropriately.

Figure 2B:
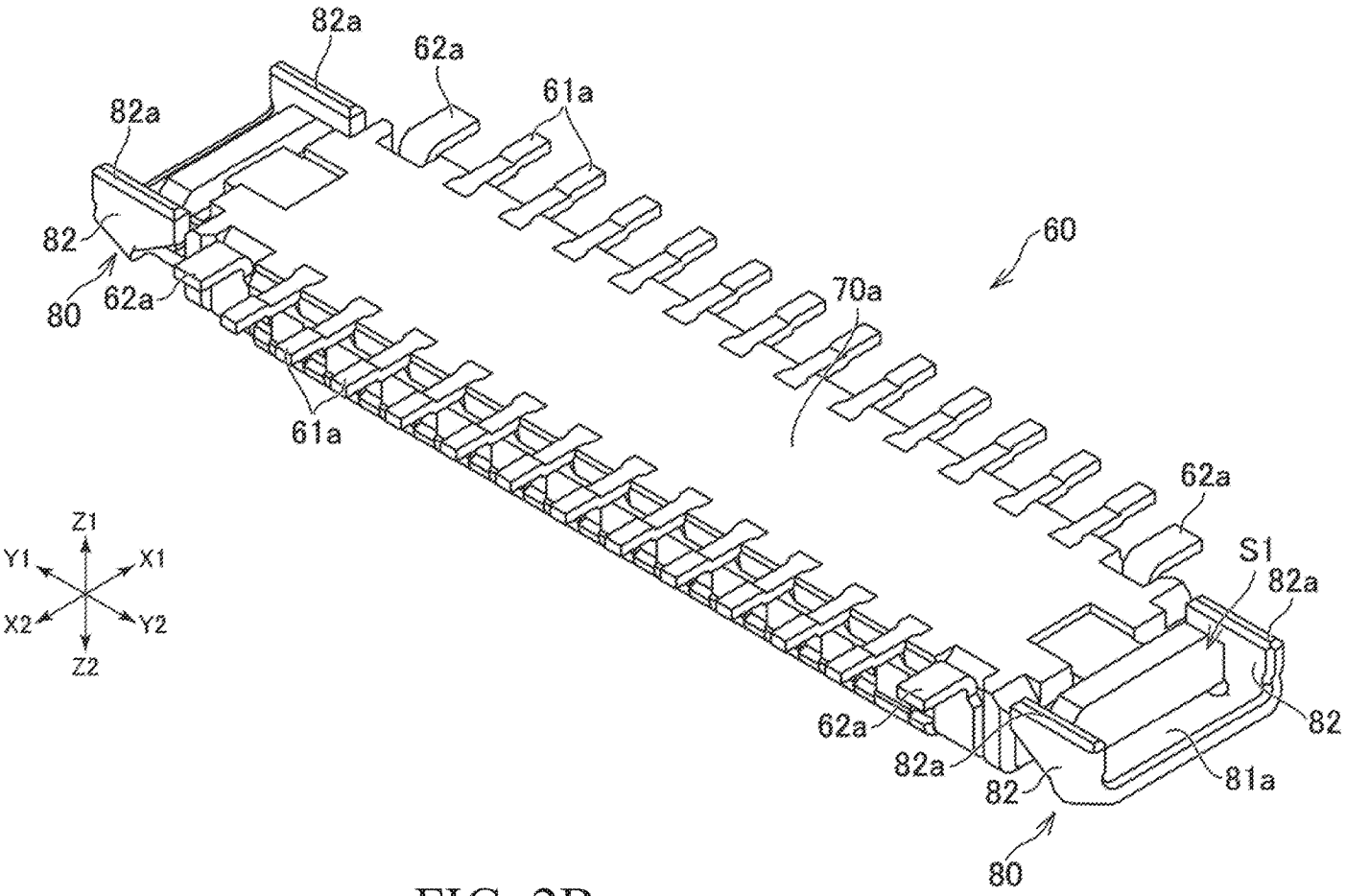
FIG. 2B is a perspective view illustrating a lower surface of the second connector.

As illustrated in FIG. 2B, the second securing metal fitting 80 can have an overhang part 81*a* on the top plate part 81. The overhang part 81*a* extends further to the outside than the outer surface of the second wall part 72 (surface that faces the outside in the longitudinal direction of the connector), and is eave-shaped. Therefore, the plug connector 60 has a space S1 in the lower part of the overhang part 81*a*. As illustrated in FIG. 7C, when the slider 30 is in a locked position while the connectors 10 and 60 are mated together, the end part of the slider 30 (locking part 35) is disposed in the space S1, and the overhang part 81*a* is disposed on the lower side of the locking part 35. In other words, the locking part 35 is engaged to the plug connector 60. As illustrated in FIG. 7C, the overhang part 81*a* can be inclined upwards when the connectors 10 and 60 are mated together. Thereby, the plug connector 60 can be guided to a position that is suitable for the receptacle connector, and the distance between the end part of the overhang part 81*a* and the slider 30 can be reduced. As a result, when the two connectors 10 and 60 are mated together, the change in relative position of the two connectors 10 and 60, or in other words, rattling of the plug connector 60 can be more effectively controlled.

Operating Method

Movements for fitting together the receptacle connector 10 and the plug connector 60 are described below.

When the receptacle connector 10 is mounted to the circuit board, the substrate connecting part 11*a* of the first terminal 11 and the securing parts 42*d* and 42*e* of the first securing metal fitting 40 are connected to a connecting pad of the circuit board by solder or the like. Furthermore, when the plug connector 60 is mounted to the circuit board W, the substrate connecting part 61*a* of the second terminal 61, the substrate connecting part 62*a* of the third terminal 62, and the securing part 82*a* of the second securing metal fitting 80 are mounted to the connecting pad or the like of the circuit board by solder or the like.

An operator pulls out the operating part 32 of the slider 30 of the receptacle connector 10 using a finger or a tool, and places the slider 30 in an unlocked position (refer to FIG. 6B and FIG. 7B). Thereby, a hook 43 of the first securing metal fitting 40 is engaged to the second engageable part 34 of the slider 30, and further movement of the slider 30 to the outside in the longitudinal direction is controlled. The operator causes the mating surface which is the upper surface of the receptacle connector 10 to face the mating surface which is the upper surface of the plug connector 60. Thereby, a groove formed between the first wall part 21 of the receptacle connector 10 and the center protrusion 23 faces the first wall part 71 of the plug connector 60. The operator mates the receptacle connector 10 and the plug connector 60 while in this condition. As a result, the first terminal 11 of the receptacle connector 10 is electrically connected to the second terminal 61 of the plug connector 60.

Next, the operator presses the operating part 32 of the slider 30 to the inside in the longitudinal direction using a finger or a tool. In other words, the operator moves the slider 30 to the locked position while resisting the elastic force of the hook 43 in order to engage the hook 43 of the first securing metal fitting 40 to the first engageable part 33 of the slider 30. Thereby, the overhang part 81*a* of the top plate part 81 of the second securing metal fitting 80 of the plug connector 60 is placed on the lower side of the locking part 35 of the slider 30. In other words, the locking part 35 is inserted in the space S1 on the upper side of the overhang part 81*a*. As a result, the receptacle connector 10 and the plug connector 60 change to a locked position, and can prevent the receptacle connector 10 and the plug connector 60 from separating due to an unintentional phenomenon such as shock, incorrect operation by the operator, or the like.

Furthermore, when separating the receptacle connector 10 and the plug connector 60, the operator pulls the operating part 32 of the slider 30 to the outside in the longitudinal direction. In other words, the operator moves the slider 30 to the lock removal position while resisting the elastic force of the hook 43. When doing so, the hook 43 of the first securing metal fitting 40 is engaged to the second engageable part 34 of the slider 30. Furthermore, the locking part 35 of the slider 30 no longer faces the overhang part 81*a* of the second secured metal fitting 80 of the plug connector 60. In other words, the locking part 35 is pulled from the space S1 on the upper side of the overhang part 81*a* to the outside in the longitudinal direction of the connector. As a result, the lock for the receptacle connector 10 and the plug connector 60 is relieved, and the receptacle connector 10 and the plug connector 60 are separated.

As described above, the receptacle connector 10 is supported by the second wall part 22 and has a slider that can slide in the longitudinal direction and the first securing metal fitting 40 attached to the second wall part 22. The slider 30 can slide between a locked position (FIG. 6C and FIG. 7C) in which the slider 30 locks the plug connector 60 that mates to the inside of the concave part E1 and a lock relieving position (FIG. 6B and FIG. 7B) in which the slider 30 is separated to the outside in the longitudinal direction from the plug connector 60 and the lock of the plug connector 60 is relieved. The first securing metal fitting 40 has the hook 43, and the slider 30 has the first engageable part 33 that engages with the hook 43. The hook 43 is elastically deformable. The slider 30 controls the movement from the lock position to the unlocked position by engagement between the hook 43 and the first engageable part 33, and sliding between the locked position and the unlocked position is permitted by the elastical deformation of the hook 43. With the receptacle connector 10, movement of the plug connector 60 in relation to the receptacle connector 10 can be suppressed and the stability of the electrical connection can be improved by placing the slider 30 in the locked position. Also, it is possible to prevent the operator from inadvertently moving the slider 30 from the locked position to the unlocked position by the hook 43.

Note, the connector assembly and the connector proposed in the present disclosure are not restricted to the examples of connectors 10 and 60 described above, but can have various variations.

For example, the first and second securing metal fittings 40 and 80 in the connectors 10 and 60 may have the securing parts 42*d*, 42*e*, and 82*a* on the circuit board, or may not have the securing parts 42*d*, 42*e*, and 82*e*. Thereby, only the substrate connecting parts 11*a* and 61*a* of the first and second terminals 11 and 61 can be connected to the connecting pad of the circuit board by the solder or the like.

Furthermore, in the example of the receptacle connector 10, the first securing metal fitting 40 has the hook 43 as the engaging part that engages the engageable parts 33 and 34 of the slider 30. However, the engaging part does not have to be hook-shaped. In other words, the engaging part does not have to have a curve at the base part 43*b*.

As another example, an elastically deformable engaging part can be formed on the slider 30. Thereby, the engaging part formed on the first securing metal fitting 40 can be elastically deformable, or not elastically deformable.

In the example of the receptacle connector 10, the two hooks (engaging parts) 43 with the slider 30 provided therebetween are mutually connected by passing through the top plate part 41. However, the two hooks 43 can be mutually connected by passing through a different part than the top plate part 41. Thereby, the number of parts can be reduced by having the two hooks 43 connected to each other, or in other words, by providing two hooks 43 on one of the first securing metal fittings 40.

In another example, the number of sliders 30 of the receptacle connector 10 can be one.

The present disclosure is not restricted to one example, and variations that maintain the gist of the present disclosure that can easily be conceived by a person skilled in the art by providing suitable variations are included within the scope of the present disclosure. The widths, thicknesses, and shapes of the portions illustrated in the drawing are illustrated schematically and are not intended to limit the interpretation of the present disclosure.

The invention claimed is:

1. A connector assembly, comprising:

a first connector including: a first housing having two first wall parts extending in a longitudinal direction and opposing in a short direction, two second wall parts positioned on end parts of the two first wall parts and opposing in the longitudinal direction, and a recessed part formed on an inner side of the first wall parts and second wall parts; and a first terminal retained on the first wall parts; and a second connector including: a second terminal for connecting to the first terminal, and a second housing retaining the second terminal, the second connector being mated to an inner side of the recessed part of the first housing; wherein:

the first connector includes: a slider supported by at least one of the two second wall parts and that can slide in the longitudinal direction; and a first metal fitting attached to at least one second wall part, the slider can slide between a locking position where the slider locks the second connector mated to the inner side of the recessed part and a lock releasing position where the slider is separated from the second connector to an outer side in the longitudinal direction such that locking of the second connector is released, the first metal fitting has an engaging part, the slider has a first engageable part to which the engaging part is engaged, at least one of the engaging part and first engageable part can elastically deform, and movement of the slider from the locking position to the lock releasing position is restricted by engagement between the engaging part and the first engageable part, and sliding between the locking position and lock releasing position is permitted by at least one of the aforementioned parts.

2. The connector assembly according to claim 1, wherein the engaging part is positioned on an outer side in the short direction with regard to the slider, and the first engageable part is formed on an edge of the slider.

3. The connector assembly according to claim 2, wherein two engaging parts positioned on mutually opposite sides in the short direction are provided as the engaging part, and the slider is disposed between the two engaging parts.

4. The connector assembly according to claim 1, wherein the engaging part has a stretching part that can extend toward the inner side in the longitudinal direction and move in a direction orthogonal to the longitudinal direction due to elastic deformation of the engaging part, and an end part of the stretching part contacts the first engageable part and regulates movement of the slider to the lock releasing position when the slider is in the locking position.

5. The connector assembly according to claim 1, wherein the engaging part can elastically deform, the engaging part has a base part and a stretching part that can elastically deform extending from the base part, the first metal fitting has a wall part having on a lower edge a securing part attached to a circuit board, and the base part of the engaging part connects to the wall part.

6. The connector assembly according to claim 1, wherein the slider further has a second engageable part to which the engaging part is engages, and the second engageable part regulates sliding of the slider from the lock releasing position further to the outer side in the longitudinal direction, due to engagement between the engaging part and second engageable part.

7. The connector assembly according to claim 1, wherein the slider is disposed on an upper side of the second wall part, the first metal fitting has two engaging mechanism parts that sandwich the slider in the short direction and are positioned on mutually opposite sides, and the first metal fitting is positioned on the upper side of the slider, is positioned between the two engaging mechanism parts, and has a top plate part connecting the engaging mechanism parts.

8. The connector assembly according to claim 1, wherein the first metal fitting is a member having at least one of a guiding part that guides the second connector to the inner side of the recessed part of the first housing, a terminal part that connects to a terminal of the second connector, and a part to be retained that is secured to an inner surface of the recessed part of the first housing.

9. A connector, comprising:

a housing having two first wall parts extending in a longitudinal direction and opposing in a short direction, two second wall parts positioned on end parts of the two first wall parts and opposing in the longitudinal direction, and a recessed part formed on an inner side of the first wall parts and second wall parts;

a terminal retained by the housing;

a slider supported by at least one of the two second wall parts and that can slide in the longitudinal direction; and a metal fitting attached to at least one of the second wall parts; wherein:

the slider can slide between a locking position where the slider locks a mating connector mated to the inner side of the recessed part and a lock releasing position where the slider is separated from the mating connector to an outer side in the longitudinal direction such that locking of the mating connector is released, the metal fitting has an engaging part, the slider has a first engageable part to which the engaging part is engaged, at least one of the engaging part and first engageable part can elastically deform, and movement of the slider from the locking position to the lock releasing position is restricted by engagement between the engaging part and the first engageable part, and sliding between the locking position and lock releasing position is permitted by at least one of the aforementioned parts.

* * * * *